US006779224B2

(12) United States Patent
Mizukoshi

(10) Patent No.: US 6,779,224 B2
(45) Date of Patent: Aug. 24, 2004

(54) BRUSH CORRECTING DEVICE FOR TOOTHBRUSH

(75) Inventor: Mayuki Mizukoshi, Matsudo (JP)

(73) Assignee: Akiko Kiyo Mizukoshi, Chiba (JP)

( * ) Notice: Subject to any disclaimer, the term of this patent is extended or adjusted under 35 U.S.C. 154(b) by 286 days.

(21) Appl. No.: 10/088,490

(22) PCT Filed: Apr. 4, 2001

(86) PCT No.: PCT/JP01/02934

§ 371 (c)(1),
(2), (4) Date: May 15, 2002

(87) PCT Pub. No.: WO02/21971

PCT Pub. Date: Mar. 21, 2002

(65) Prior Publication Data

US 2002/0162186 A1 Nov. 7, 2002

(30) Foreign Application Priority Data

Sep. 18, 2000 (JP) ..... 2000-281453

(51) Int. Cl.[7] ..... A46B 17/04

(52) U.S. Cl. ..... 15/257.01; 15/167.1; 15/184; 15/246; 15/258; 206/362.2; 206/362.3

(58) Field of Search ..... 15/257.01, 246, 15/184, 167.1, 258; 206/362.3, 362

(56) References Cited

U.S. PATENT DOCUMENTS 5,509,168 A * 4/1996 Butler et al. ..... 15/257.01

FOREIGN PATENT DOCUMENTS

JP 10286123 * 10/1998

* cited by examiner

*Primary Examiner*—Deborah Jones
*Assistant Examiner*—Abraham Bahta
(74) *Attorney, Agent, or Firm*—Rader, Fishman & Grauer PLLC

(57) ABSTRACT

A brush correcting device for toothbrush, comprising a toothbrush support body (2) having a support part (2*a*) for supporting at least the tip side lower surface of a toothbrush (T) and one of two guide groove parts or guide elongated holes (2*e*, 2*f*) formed on the tip upper side of the toothbrush (T) supported by the support part (2*a*), and a band-shaped convergent body inserted into one or two guide groove parts or guide elongated holes (2*e*, 2*f*) and bent in U-shape, V-shape, or channel-shape at the center thereof, whereby the brush correcting device for toothbrush allowing a variety of toothbrushes to be corrected according to the shape of the brush part can be provided at a low production cost.

6 Claims, 15 Drawing Sheets

(A)

(B)

(C)

BRUSH CORRECTING DEVICE FOR TOOTHBRUSH

CROSS-REFERENCE TO RELATED APPLICATION

This application is a National Stage entry of International Application No. PCT/JP01/02934, filed Apr. 4, 2001, the entire specification claims and drawings of which are incorporated herewith by reference.

FIELD OF THE INVENTION

This invention relates to a brush reforming apparatus for a toothbrush, which reforms a deformed brush portion of a toothbrush having been used numerous times.

BACKGROUND OF THE INVENTION

Using a toothbrush for numerous times causes plastic deformation of a brush portion, and not only will teeth be prevented from being effectively brushed, but in some cases may even effect one's gum when the brush portion is deformed to a point unbearable for use. Accordingly, the user purchases a new toothbrush whenever necessary. However, the bristles comprising a brush portion of a toothbrush are mostly molded with synthetic resin. Therefore, it is known that a plastic deformed brush portion can be reformed by heating the brush portion with boiled water (or hot water having a relatively high temperature), and then cooling the brush portion with cold water, in a case when the brush portion is formed from synthetic resin.

An apparatus, which has a spring member binding substantially the entire body of a brush portion from the distal end of a toothbrush, and a fixing member for fixing the spring member with the distal end of the brush portion, can be given as a conventional example of an apparatus for reforming a brush portion of a toothbrush, as shown in Japanese Utility Model Publication Nos. Sho58-152136, Sho59-38833, and Hei7-3361. Another apparatus, which has a reforming apparatus body for binding substantially the entire body of a brush portion from the distal end of a toothbrush, and an openable operating means being integrally formed to the reforming apparatus body, is also shown in Japanese Patent Publication No. Hei7-289356. Accordingly, in each of the foregoing conventional reforming apparatuses, a brush portion of a toothbrush is bound by the spring member or the reforming apparatus body, the brush portion is then applied with boiled water or steeped into hot water, and the brush portion is then cooled with cold water, thereby, the brush portion of the toothbrush is reformed back to a state similar to a state prior of it's use.

Toothbrushes, meanwhile, exist in a vast variety of shapes and sizes, and various toothbrushes have been developed with consideration of usage by adults and children, different preferences of use, different brushing performance, etc. More particularly, the use of electric toothbrushes has spread in recent years.

Nevertheless, according to each of the above-described conventional reforming apparatuses (brush reforming apparatuses for a toothbrush), since the spring member or the reforming apparatus body for binding the brush portion of the toothbrush are formed in a single predetermined shape, the spring member or the reforming apparatus body requires preparation of a reform apparatus for each corresponding toothbrush in order to be used upon various brush portions of toothbrushes. That is, a vast variety of reforming apparatuses corresponding to every each shape of a toothbrush, size or length of a brush portion are required to be manufactured. Consequently, an increase in manufacturing cost is unavoidable, and a vast variety of reforming apparatuses are required to be purchased even for an average family of 3 or 4 members.

Therefore, it is an object of this invention to solve the foregoing problems by providing a brush reforming apparatus for a toothbrush, which is able to reform in correspondence with the sizes of the brush portions for a vast variety of toothbrushes at an inexpensive manufacture cost.

SUMMARY OF THE INVENTION

The first invention of this application (invention described in claim 1) is a brush reforming apparatus for a toothbrush comprising: a toothbrush supporting body having; a supporting portion supporting at least a bottom surface of a distal end of a toothbrush; and one or two guiding groove portion(s) or one or two guiding elongated slot(s) being formed above the distal end of the toothbrush supported by the supporting portion; and a binding body having a belt-like shape, the binding body being inserted through the one or two guiding groove portion(s) or the one or two guiding elongated slot(s), and the binding body being bent at a center of the binding body into a U letter, a V letter, or a rectangular C letter shape. According to the first invention, a distal end of a toothbrush is supported by a supporting portion formed to a toothbrush supporting body, and a binding body is moved in a direction toward the distal end of the toothbrush or in a direction opposite from the distal end of the toothbrush, thereby, a brush portion of a toothbrush is bound by the binding body. Accordingly, the first invention can bind a brush with extreme ease and quickness, and provide binding whether a brush portion of a toothbrush is long or short. In a state where a brush is bound by the toothbrush reforming apparatus, a method, for example, in which the toothbrush reforming apparatus is applied with boiled water or steeped into hot water, and then cooled by cold water or the like, allows the brush to be reformed into an ideal state.

The second invention (invention described in claim 2) is a brush reforming apparatus for a toothbrush comprising: a toothbrush supporting body having; one supporting portion supporting at least a bottom surface of a distal end of a toothbrush; other supporting portion being formed opposite to a position where the one supporting portion is formed, the other supporting portion supporting at least the bottom surface of the distal end of the toothbrush, and the other supporting portion supporting from at a position above or below a supporting position of the one supporting portion; and one or two guiding groove portion(s) or one or two guiding elongated slot(s) being formed between the one supporting portion and the other supporting portion, and being formed above the distal end of the toothbrush supported by the one supporting portion or the other supporting portion; and an endless binding member having a belt-like shape and being inserted through the one or two guiding groove portion(s) or the one or two guiding elongated slot(s). According to the second invention, a toothbrush supporting body is formed with one supporting portion for supporting a distal end of a toothbrush and another supporting portion also for supporting the distal end of the toothbrush, the one supporting portion and the other supporting portion are formed different in terms of the height for providing support, and a belt-like endless binding body is provided as a component of the invention, thereby, the second invention is not only able to reform a brush portion of various length as in the first invention, but is also able to reform a brush portion having a brush (bristles) of various height, in which the distal end of a toothbrush is supported by selecting either the one supporting portion or the other supporting portion for providing secure reformation.

The third invention (invention described in claim 3) is a brush reforming apparatus for a toothbrush according to the first or second invention, wherein the toothbrush supporting body has a supporting member formed with a supporting portion supporting at least a bottom surface of a distal end of the toothbrush, and a binding body supporting member being attachable to the supporting member while having the one or two guiding groove portion(s) or the one or two guiding elongated slot(s) formed thereto; and wherein the supporting member and the binding body supporting member are attached variably and adjustably for arranging a position of a supporting portion formed in the supporting member and a position of the one or two guiding groove portion(s) or the one or two guiding elongated slot(s) separate from or proximate to each other. According to the third invention, a toothbrush supporting body, which has a supporting member and a binding body supporting member being separated from each other, is formed to be variably adjustable by arranging a supporting portion of the supporting member proximal to or distal to one or two guiding groove portions or a guiding elongated slot, thereby, as in the same manner as the second invention, the third invention is also able to reform a brush portion having a brush (bristles) of various height, in which the distal end of a toothbrush is supported by selecting either the one supporting portion or the other supporting portion for providing secure reformation.

The fourth invention (invention described in claim 4) is a brush reforming apparatus for a toothbrush comprising: a toothbrush supporting body having; a supporting portion having a plane shape molded into a substantially V letter shape, the supporting portion having an open side thereof being closable, the supporting portion supporting a bottom surface of a distal end of a toothbrush during a closed state; one guiding groove portion or one guiding elongated slot formed on one side of the open side; other guiding groove portion or other guiding elongated slot formed on the other side of the open side; and a binding body having a belt-like shape, the binding body being bent at a center thereof into an arc-like shape; the binding body having a midsection on one end thereof for insertion through the one guiding groove portion or the one guiding elongated slot; and the binding body having a midsection on the other end thereof for insertion through the other guiding groove portion or the other guiding elongated slot. According to the fourth invention, a distal end of a toothbrush is inserted from an open side of an opened toothbrush supporting body; the opened side of the toothbrush supporting body is then closed, and a belt-like binding body is then operated to a direction opposite from the distal end of the toothbrush, thereby, a brush (bristles) of the toothbrush can be bound. Accordingly, as in the same manner as the first invention, this fourth invention can also provide secure binding of a brush.

The fifth invention (invention described in claim 5) is a brush reforming apparatus for a toothbrush according to the first, second, third, or fourth invention, wherein the one or two guiding groove(s) or the one or two guiding elongated slot(s) has or have an arc-like or wave-like shape in which the binding body or the endless binding body is inserted therethrough, or the one or two guiding groove(s) or the one or two guiding elongated slot(s) has a protrusion formed at a wall thereof or the toothbrush supporting body has a horizontal rod formed at a front surface thereof and the binding body or the endless binding body has a recessed groove or an elongated slot formed thereto to allow insertion of the protrusion or the horizontal rod through the recessed groove or the elongated slot.

According to the fifth invention, the one or two guiding groove(s) or the one or two guiding elongated slot(s) has or have an arc-like or wave-like shape in which the binding body or the endless binding body is inserted therethrough, or the one or two guiding groove(s) or the one or two guiding elongated slot(s) has a protrusion formed at a wall thereof or the toothbrush supporting body has a horizontal rod formed at a front surface thereof and the binding body or the endless binding body has a recessed groove or an elongated slot formed thereto to allow insertion of the protrusion or the horizontal rod through the recessed groove or the elongated slot, thereby, the fifth invention prevents the bristles of a brush from being caught into the guiding groove or the guiding elongated slot in operating with the binding body or the endless binding body and provide secure reformation.

The sixth invention (invention described in claim 6) is a brush reforming apparatus for a toothbrush comprising: a binding body or an endless binding body having a belt-like shape, and a midsection bent in an arc-like shape to form an arc-like portion; a supporting portion being fixed proximate to the arc-like portion of the binding body or the endless binding body, and supporting at least a bottom surface of a distal end of a toothbrush; and a moving member being movable in a direction toward the supporting portion or a direction opposite from the supporting portion while being guided by the binding body or the endless binding body, the moving member being formed with an elongated slot or a groove portion for inserting the binding body or the endless binding body therethrough. According to the sixth invention, a moving member moves in association with the binding body for binding the brush; accordingly, the thus structured invention can also provide secure binding of a brush.

DESCRIPTION OF THE PREFERRED EMBODIMENTS

Plural embodiments regarding this invention will hereinafter be explained with reference to the drawings. The first embodiment of a brush reforming apparatus 1 for a toothbrush will first be explained.

Figure 1:
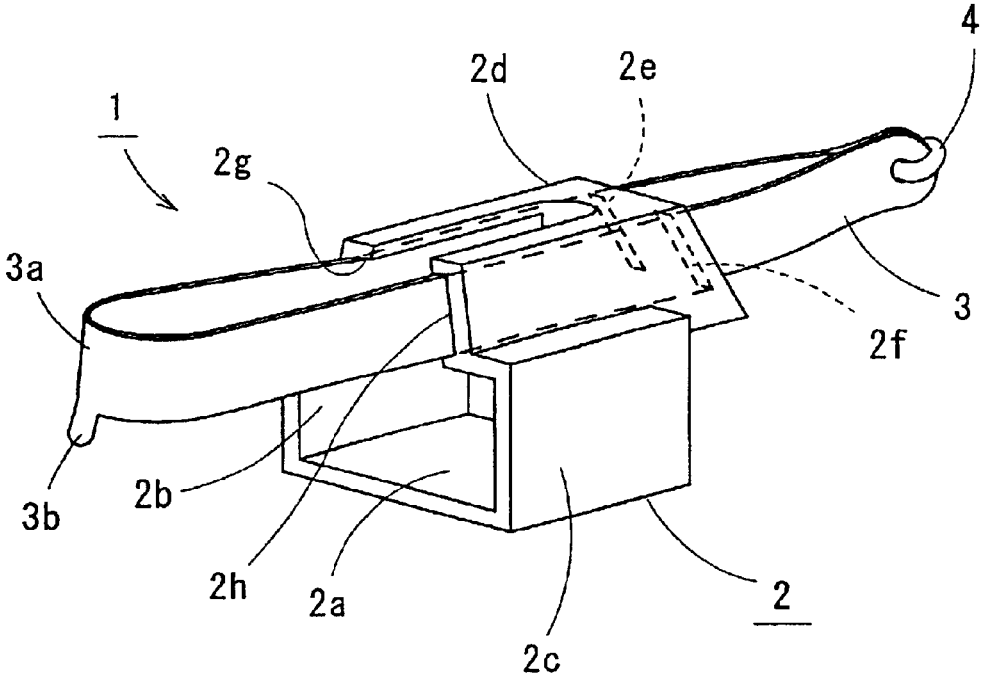
FIG. 1 is a perspective view showing a toothbrush reforming apparatus of the first embodiment.
Figure 2:
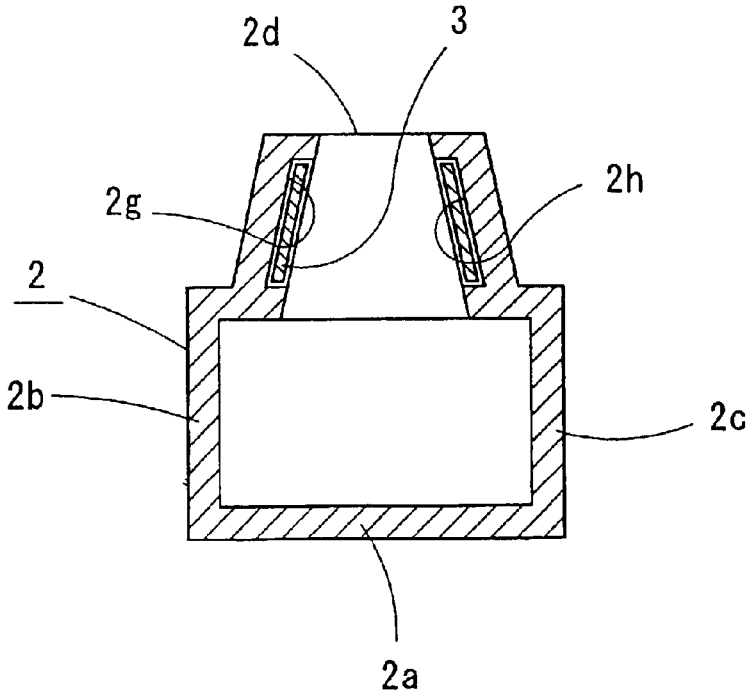
FIG. 2 is a cross-sectional view of the toothbrush reforming apparatus shown in FIG. 1.

The brush reforming apparatus for a toothbrush 1 is comprised of a toothbrush supporting body 2 and a binding body 3, as shown in FIG. 1. The toothbrush supporting body 2 is integrally molded with synthetic resin, wood, hard-rubber or metal, and has a supporting portion 2*a* whose top surface serves as a supporting face for supporting the bottom surface of a brush portion B of a toothbrush T, and a left erect portion 2*b* and a right erect portion 2*c* erected on both left and right side of the supporting portion 2*a*. That is, in the brush reforming apparatus 1 of the first embodiment, the supporting portion 2*a*, the left erect portion 2*b* and the right erect portion 2*c* form an insertion space for inserting the brush portion B formed on a distal end of the toothbrush T, as shown in FIG. 2. A binding body supporting portion 2*d* having a plane shape formed as a rectangular C letter shape is formed on a upper portion of the brush reforming apparatus 1; a left guiding elongated slot 2*e* is formed on a left side of an upper portion of a distal end of an inserted brush portion B; and a right guiding elongated slot 2*f* is formed on a right side of the upper portion of a distal end of an inserted brush portion B. The binding body supporting portion 2*d* has a left guiding groove portion 2*g* formed at an inner side thereof in front of the left guiding elongated slot 2*e*, and a right guiding groove portion 2*h* formed at an inner side thereof in front of the right guiding elongated slot 2*f*. It is now to be noted that the left guiding elongated slot 2*e* and the right guiding elongated slot 2*f* are inclined toward each other to form a separated upside down V letter-like shape, and that the left guiding groove portion 2*g* and the right guiding groove portion 2*h* also form a separated upside down V letter-like shape in correspondence to the left guiding elongated slot 2*e* and the right guiding elongated slot 2*f*.

Further, in the brush reforming apparatus 1, the binding body 3 having a belt-like form is inserted through the left guiding elongated slot 2*e*, the left guiding groove portion 2*g*, the right guiding elongated slot 2*f* and the right guiding groove portion 2*h*. The binding body 3 is molded into a belt-like form with synthetic resin, wood, hard rubber or metal; both ends of the binding body 3 are secured to each other with a ring-like metal fitting 4; an arc-like portion 3*a* with a bent arc-like shape is formed on an opposite side of the metal fitting 4; and a pressing portion 3*b* for pressing an upper surface of the toothbrush T with a finger when operating the binding portion 3 is formed at a bottom end of the arc portion 3*a*.

Figure 3:
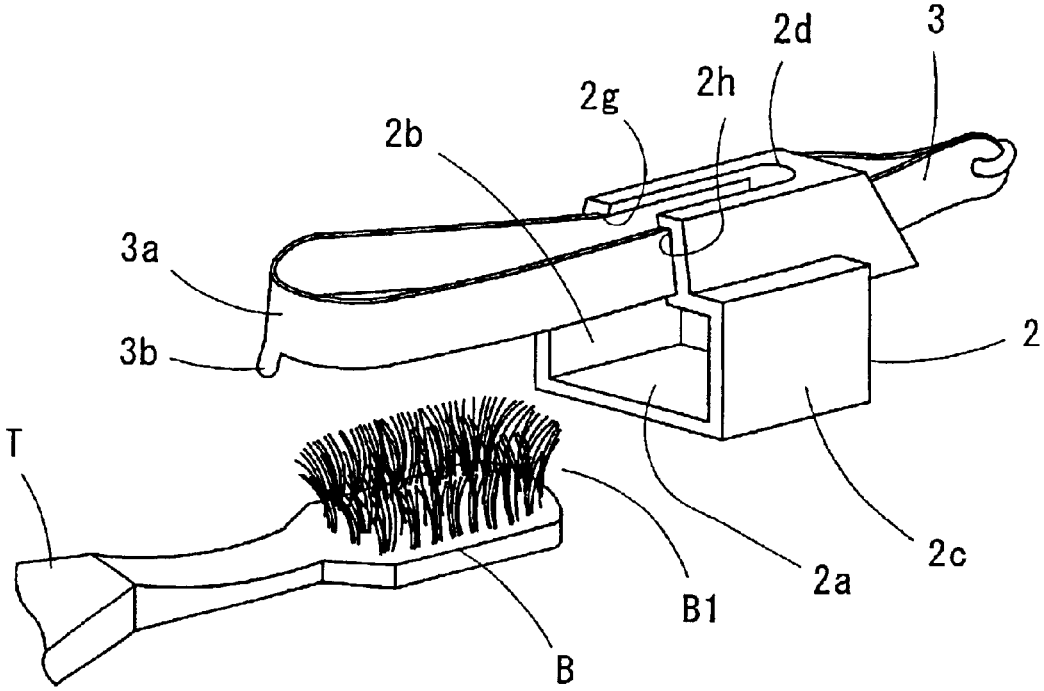
FIG. 3 is a perspective view showing a state prior to binding of a brush portion of a toothbrush.
Figure 4:
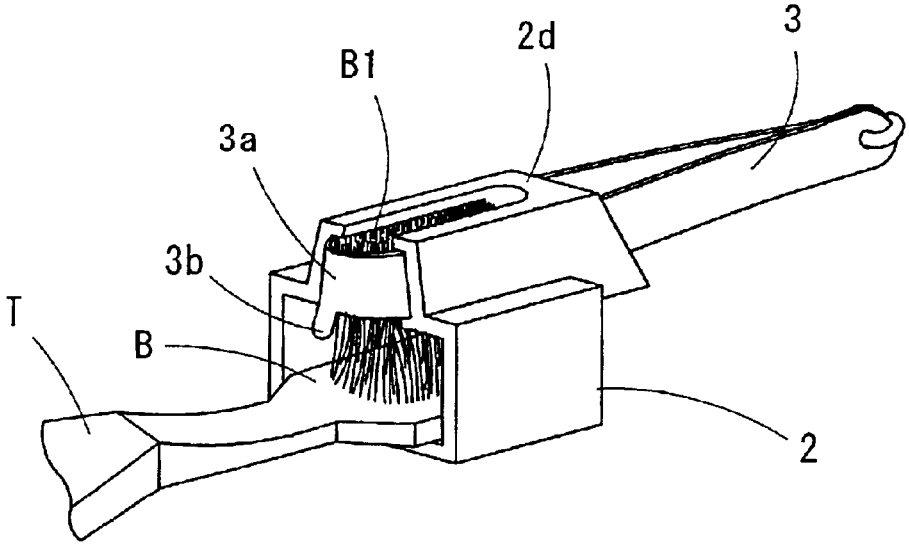
FIG. 4 is a perspective view showing a bound state of a brush portion.

According to the brush reforming apparatus 1 of the first embodiment, in a state where the binding body 3 is projected toward the front side as shown in FIG. 3, the brush portion B of the toothbrush T is inserted through the binding body 3, and the binding body 3 having the brush portion B inserted therethrough is then either inserted into the insertion space in a manner placed upon the supporting portion 2*a* of the supporting portion 2*a*, or has one end thereof pulled in a direction toward the distal end of the brush B by being guided by the left guiding elongated slot 2*e* along with the left guiding groove portion 2*g* and the right guiding elongated slot 2*f* along with the right guiding groove portion 2*h*, thereby, the brush B1 of the brush portion B is bound at the other end of the binding body 3.

Accordingly, in such state, a plastic deformed brush B1 is steeped into boiled water or relatively hot water and is then cooled (or returned to normal temperature) with cold water to be reformed into a state similar to an original state thereof.

Consequently, with the brush reforming apparatus 1 of the first embodiment, the brush B1 of the brush portion B of the toothbrush T can be bound easily by operating the binding body 3 in the above-described manner. More particularly, according to the brush reforming apparatus 1, the binding body 3 can securely bind the brush B1 whether the length of the brush portion B1 is long or short owing to the belt-like structure thereof.

Figure 5:
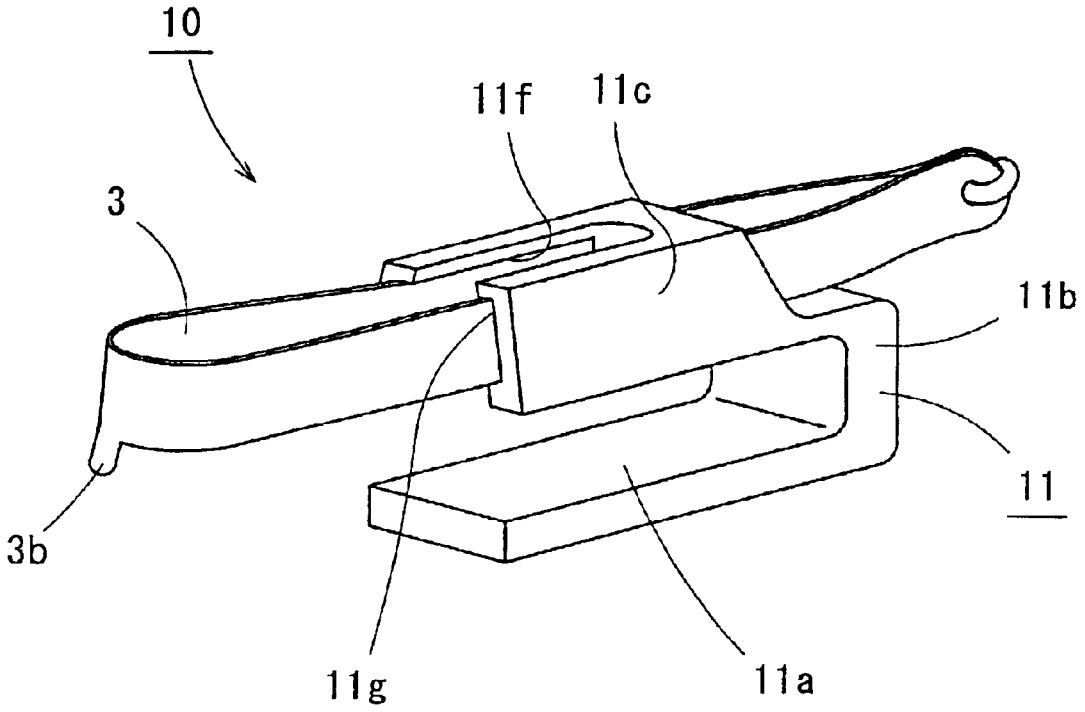
FIG. 5 is a perspective view showing a toothbrush reforming apparatus of the second embodiment.
Figure 6:
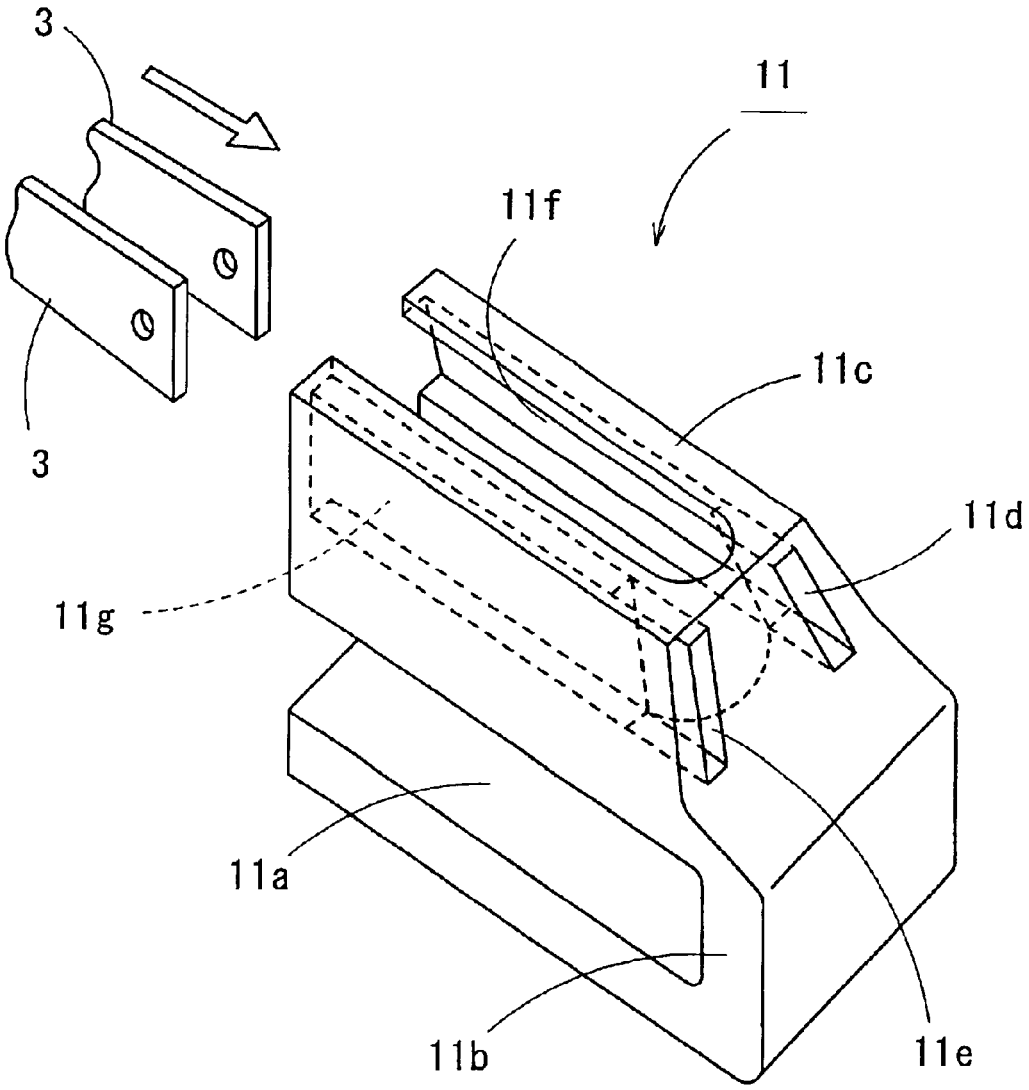
FIG. 6 is a perspective view showing a brush supporting body from a rear side.

Next, a second embodiment of a brush reforming apparatus 10 for a toothbrush will be explained in detail with reference to the drawings. The brush reforming apparatus 10 is comprised of a toothbrush supporting body 11 and the binding body 3, as shown in FIG. 5. Unlike the brush reforming apparatus 10 of the first embodiment, the brush reforming apparatus 10 has a characteristic of not having a left erect portion 2*b* and a right erect portion 2*c*. That is, the toothbrush supporting body 11 is comprised of a supporting portion 11*a* for supporting the brush portion B of the toothbrush T, a rear side erect portion 11*b* being erect upward from a rear side of the supporting portion 11*a*, and a binding body supporting portion 11*c* formed at an top end of the rear side erect portion 11*b*. The binding body supporting portion 11*c* is formed of a left elongated slot 11*d* and a right elongated slot 11*e* for guiding an insertion of the binding body 3, a left guiding groove portion 11*f*, and a right guiding groove portion 11*g*, as shown in FIG. 6. It is now to be noted that the description of the binding body 3 shall be omitted since the binding body 3 has the same structure as that of the binding body 3 of the first embodiment.

Figure 7:
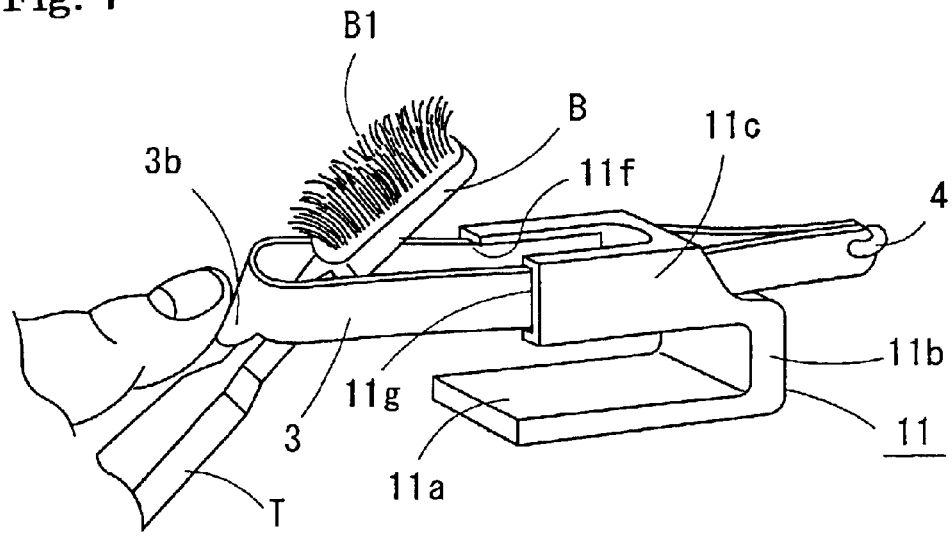
FIG. 7 is a view showing a method of using the toothbrush reforming apparatus shown in FIG. 5, in which (A) is a perspective view showing a brush portion of a toothbrush inserted into a binding body, (B) is a right side view showing a state prior to moving of a toothbrush supporting body, and (C) is a perspective view showing a state after a binding body has been drawn subsequent to the moving of the toothbrush supporting body.
Figure 7:
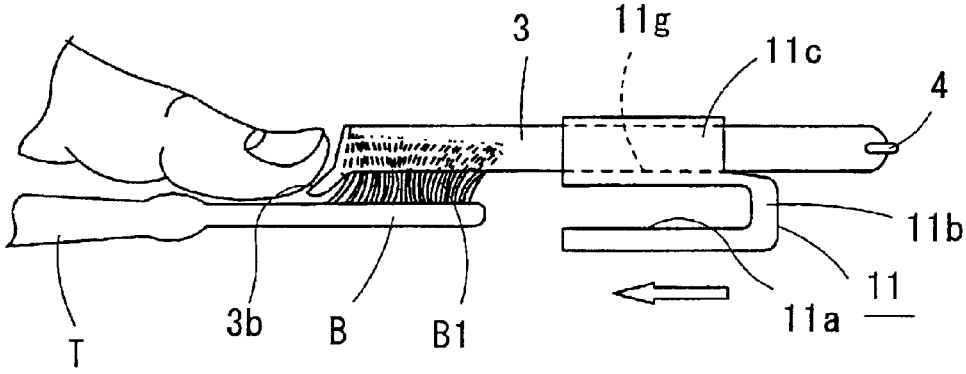
Figure 7:
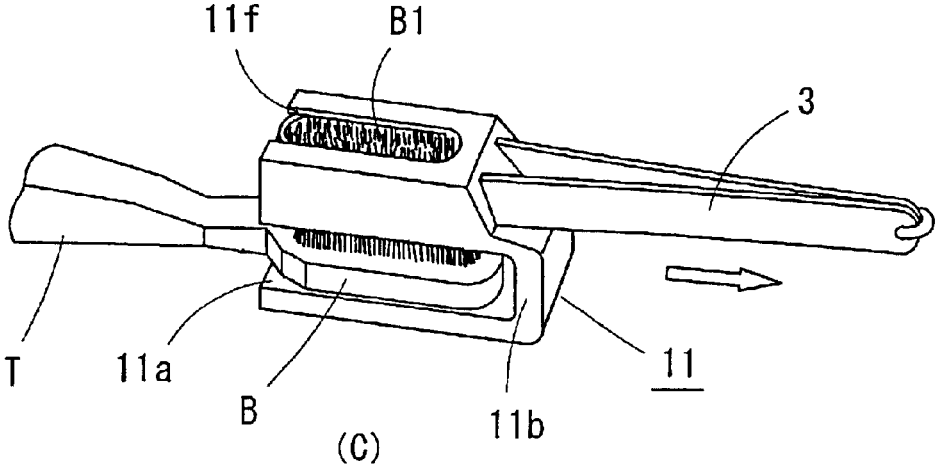

The brush reforming apparatus 10 of the second embodiment, the brush portion B of the toothbrush T is inserted into the binding body 3 from below in a state where the binding body 3 is pulled toward the front as shown in FIG. 7(A), and the brush B1 is then positioned inside the binding body 1, and then either the toothbrush supporting body 11 is moved in an arrow direction or the binding body 3 is moved in an opposite direction of the arrow as shown in FIG. 7(B). Subsequently, the binding body 3 is pulled in an arrow direction as shown in FIG. 7(C). With such operation, the binding body 3 and the toothbrush supporting body 11 can easily bind the plastic deformed brush B1. More particularly, the brush reforming apparatus 10 of the second embodiment, unlike the brush reforming apparatus 1 of the first embodiment, is formed without the left erect portion 2*b* or the right erect portion 2*c*, and the supporting portion 11*a* thereof is open on both sides; therefore, the brush reforming apparatus 10 can securely bind the brush even when the brush portion of the toothbrush is wider than the supporting portion 11*a*.

Figure 8:
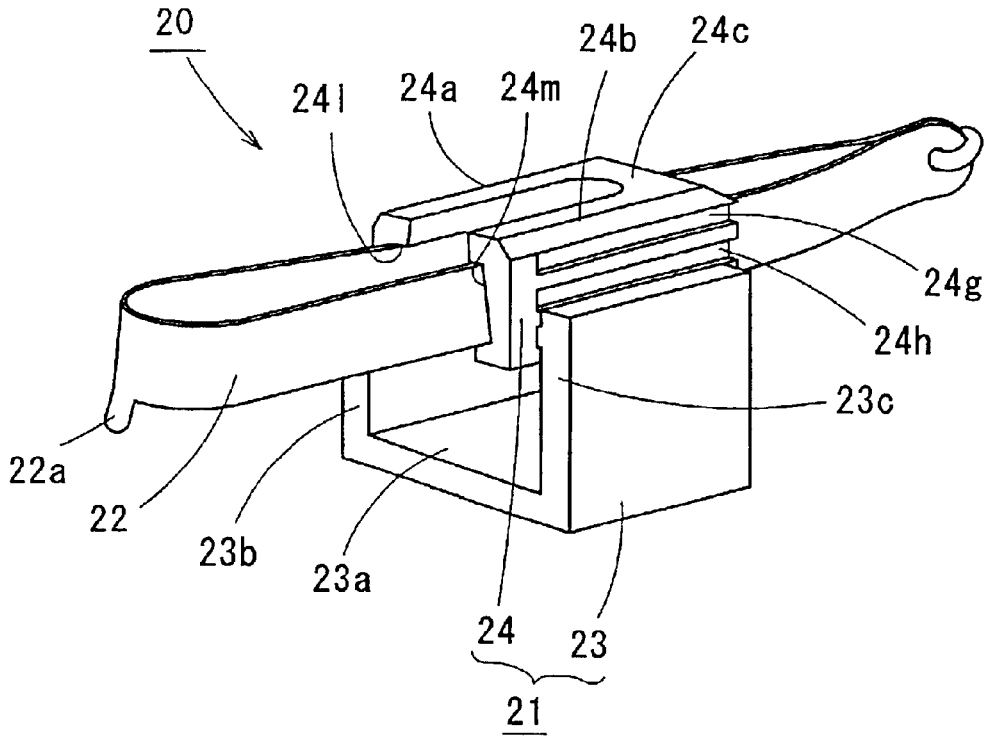
FIG. 8 is a perspective view showing a toothbrush reforming apparatus of the third embodiment.
Figure 9:
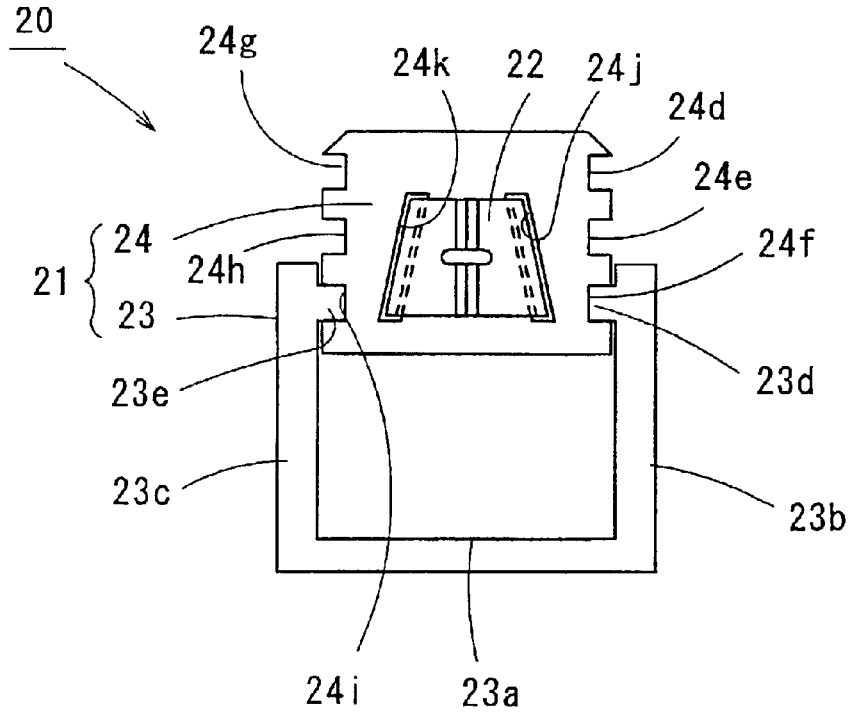
FIG. 9 is a rear view of the toothbrush reforming apparatus shown in FIG. 8.

Next, a third embodiment of a brush reforming apparatus 20 for a toothbrush will be explained in detail with reference to the drawings. The brush reforming apparatus 20 is comprised of a toothbrush supporting body 21 and a belt-like binding body 22, as shown in FIG. 8. The toothbrush supporting body 21 is comprised of a supporting member 23 formed with integrally molded synthetic resin, wood, hard rubber, or metal, and a binding body supporting member 24 coupled to the supporting member 23. The supporting member 23 has a supporting portion 23*a* for supporting a brush portion of a toothbrush, a left erect portion 23*b* erected upward from a left end of the supporting portion 23, and a right erect portion 23*c* erected upward from a right end of the supporting portion 23*a*. A left protrusion portion 23*d* is formed at an inner side of an top end of the left erect portion 23*b* and a right protrusion portion 23*c* is formed at an inner side of an top end of the right erect portion 23*c*, as shown in FIG. 9.

The binding body supporting member 24 has a plane shape thereof molded into a substantially rectangular C letter shape as shown in FIG. 8, and is comprised of a left opposing portion 24*a* opposing the left erect portion 23*b* formed in the supporting member 23, a right opposing portion 24*b* opposing the right erect portion 23*c*, a rear side portion 24*c* coupled to the left opposing portion 24*a* on one side and coupled to the right opposing portion 24*b* on the other side. As shown in FIG. 9, three guide rails 24*d*, 24*e*, 24*f*, which allow the left protrusion portion 23*d* to be selectively inserted therethrough, are formed at an outer side of the left opposing portion 24*a*, and three guide rails 24*g*, 24*h*, 24*i*, which allow the right protrusion portion 24*d* to be selectively inserted therethrough, are formed at an outer side of the right opposing portion 24*b*. As shown in FIG. 9, a left guiding elongated slot 24*j* for insertion of a binding body 22 is formed at a left side of the rear side portion 24*c* of the binding body supporting member 24, and a right guiding elongated slot 24*k* for insertion of the binding body 22 is formed at a right side of the rear side portion 24*c* of the binding body supporting member 24. The left elongated slot 24*j* and the right elongated slot 24*k* form a separated upside down V letter-like shape as in the same manner as the left elongated slot 2*e* and the right elongated slot 2*f* of the brush reforming apparatus 1 of the first embodiment. As shown in FIG. 6, a left guiding groove portion 241 corresponding to the left elongated slot 2*e* is formed at an inner side of the left opposing portion 24*a*, and a right guiding groove portion 24*m* corresponding to the right elongated slot e is formed at an inner side of the right opposing portion 24*b*. The binding body 22 is inserted through the left guiding elongated slot 24*j*, the left guiding groove portion 241, the right guiding elongated slot 24*k* and the right guiding groove portion 24*m*. It is now to be noted that the description of the binding body 22 shall be omitted since the binding body 22 has the same structure as that of the binding body 3 of the brush reforming apparatus 1 of the first embodiment.

In the brush reforming apparatus 20 of the third embodiment, the toothbrush supporting body 21 comprised of the supporting member 23 and the binding body supporting member 24 enables the left protrusion portion 23*d* to be selectively guided and inserted through the three guide rails 24*d*, 24*e*, 24*f* formed at the left opposing portion 24*a* of the binding body supporting member 24, and the right protrusion portion 24*d* to be selectively guided and inserted through the three guide rails 24*g*, 24*h*, 24*i* formed at the right opposing portion 24*b* of the binding body supporting member 24. With such selective operation, the height of the supporting portion 23*a* formed at the supporting member 23 and the binding body 22 can be adjusted. Accordingly, in the brush reforming apparatus 20 of the third embodiment, a brush can be bound in correspondence to the toothbrush regardless of the length of the brush formed at the brush portion.

In the brush reforming apparatus 20 of the third embodiment, the position for attaching the supporting member 23 and the binding body supporting member 24 can be variably adjustable (the position of the binding body 22 being vertically adjustable) by forming the protrusion portion 23*e*, 23*d* to the supporting member 23 and forming the guide rails 24*d*, 24*e*, 24*f*, 24*g*, 24*h*, 24*i* to the binding body supporting member 24. Nevertheless, the protrusion portions can be formed to both sides of the supporting member and the guide rails can be formed to the binding body supporting member for other embodiments as well, and the number of the guide rails is not limited to three as in the brush reforming apparatus 20 of the third embodiment, but also can be, for example, two rails, or four or more rails as well.

Figure 10:
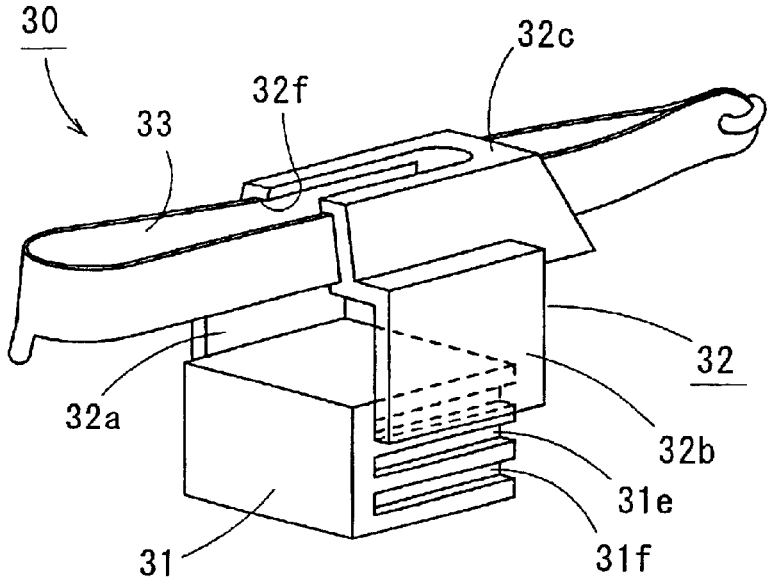
FIG. 10 is a perspective view of the toothbrush reforming apparatus of the fourth embodiment.
Figure 11:
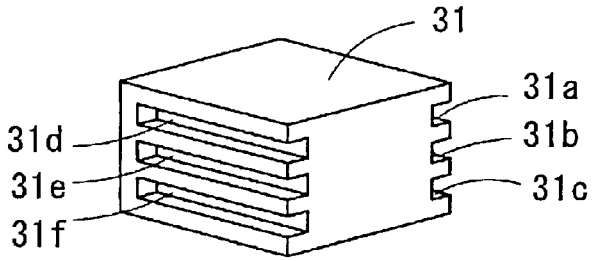
FIG. 11 is a perspective view showing a support position-adjusting member.

Next, a fourth embodiment of a brush reforming apparatus 30 for a toothbrush will be explained in detail with reference to the drawings. The brush reforming apparatus 30 of this embodiment is comprised of a support position-adjusting member 31, a binding body supporting member 32, and a binding body 33, as shown in FIG. 10. In the brush reforming apparatus 30 of this embodiment, the support position-adjusting member 31 and the binding body supporting member 32 comprise a toothbrush supporting body for this invention. The support position-adjusting member 31 serves to support a bottom surface of a distal end of a toothbrush T (described afterwards), and is molded into a rectangular parallelepiped-like shape, in which three of the guide grooves 31*a* to 31*f* are formed on both the left and right side of the support position-adjusting member 31. The binding body supporting member 32 is comprised of a left panel portion 32*a*, a right panel portion 32*b* facing the left panel portion 32*a*, and a binding body supporting portion 32*c* continuous with an upper edge of the left panel portion

Figure 12:
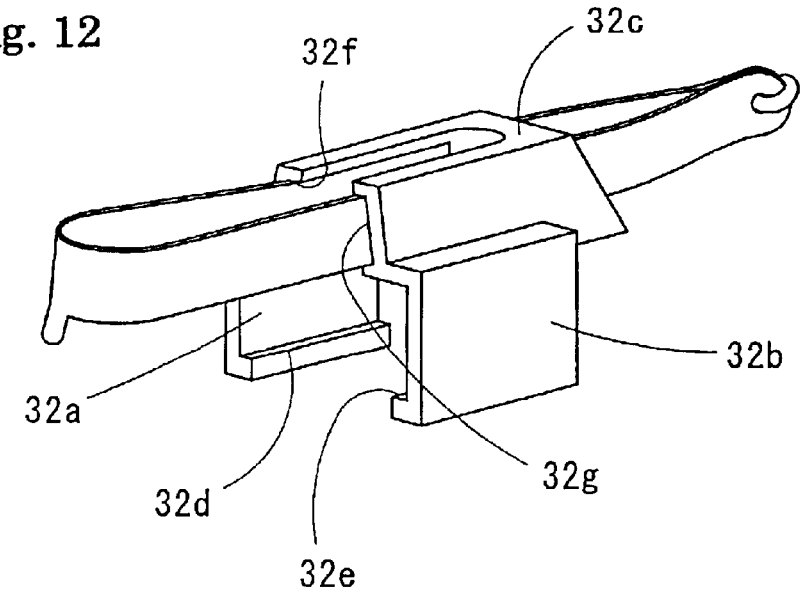
FIG. 12 is a perspective view showing a binding body supporting member and a binding body.

32*a* and an upper edge of the right panel portion 32*b*, as shown in FIG. 12. A left bent portion 32*d* for being inserted through one of the three guide grooves 31*a*, 31*b*, 31*c* is formed at a lower end of the left panel portion 32*a*, and a right bent portion 32*e* for being inserted through one of the three guide grooves 31*d*, 31*e*, 31*f* is formed at a lower end of the right panel portion 32*b*. The binding body supporting portion 32*c* has a plane shape thereof molded into a substantially rectangular C letter shape, a rear side thereof formed with two elongated slots (not shown) for inserting therethrough the binding member 33, and an inner front side thereof formed with a left guiding portion 32*f* and a right guiding portion 32*g* in the same manner as that of the toothbrush supporting body 2 comprising the brush reforming apparatus 1 of the first embodiment.

According to the tooth reforming apparatus 30 of the fourth embodiment, since the support position of the support position-adjusting member 31 for the binding body supporting member 32 is adjustable, the tooth reforming apparatus 30 can securely bind a brush of a toothbrush having a high height between a bottom surface of the brush portion and a top end of the brush as well as a brush of a tooth brush having a low height between a bottom surface of the brush portion and a top end of the brush.

Figure 13:
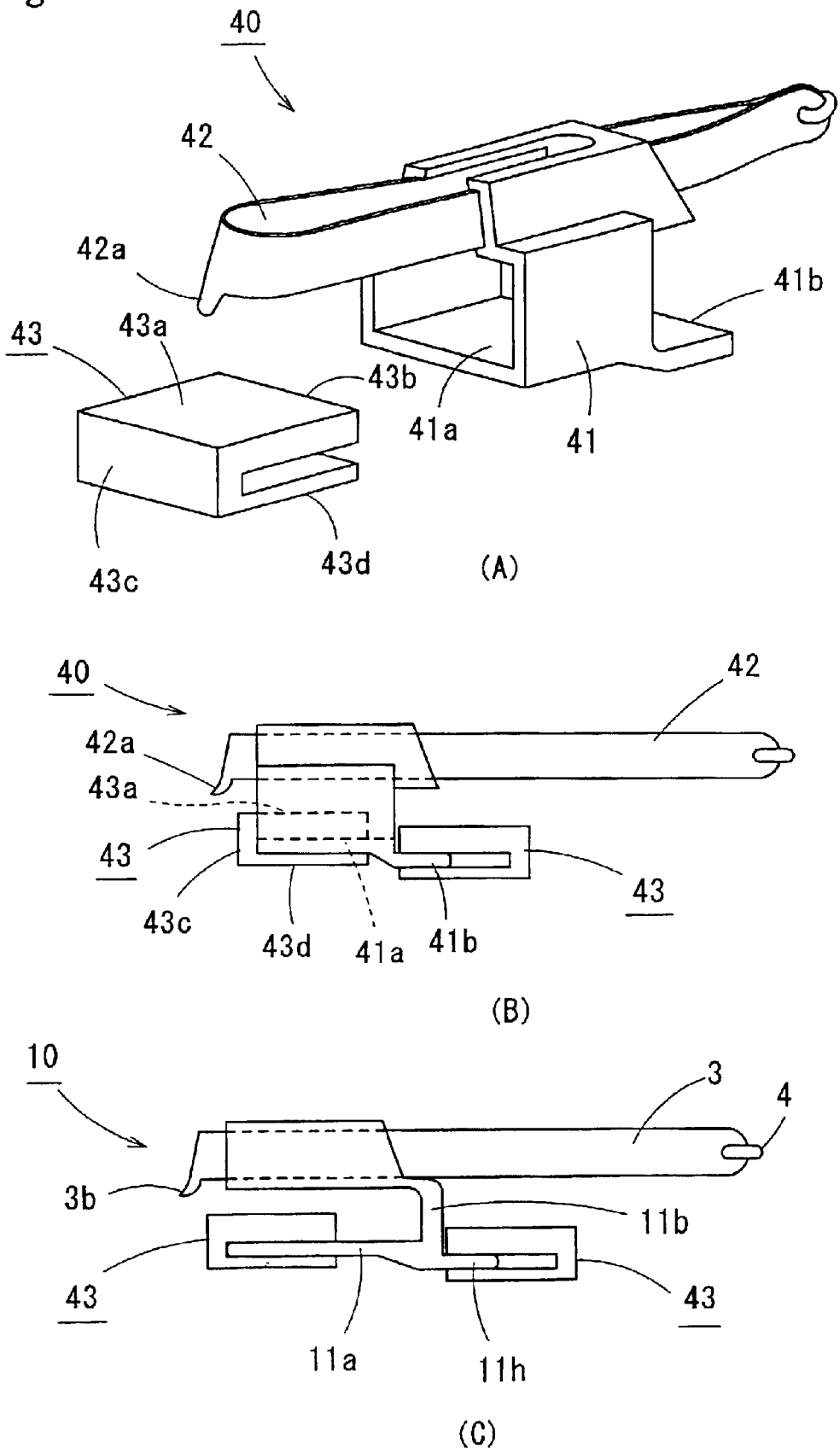
FIG. 13 is a view showing a toothbrush reforming apparatus of the fifth embodiment and a varied example thereof, in which (A) is an exploded perspective view of the toothbrush reforming apparatus of the fifth embodiment, (B) is a right side view showing an attached state of a support position-adjusting member, (C) is a right side view showing another toothbrush reforming apparatus attached with a support position-adjusting member shown in (A).

In the toothbrush reforming apparatus 30 of the fourth embodiment, the toothbrush supporting body of this invention comprised with the support position-adjusting member 31 and the binding body supporting member 32 is provided as a means to adjust the support position of a brush portion in accordance with the toothbrush to be used. However, a structure of a fifth embodiment shown in FIG. 13 (A) can also be chosen as a means for adjusting the support position of a toothbrush according to circumstance.

That is, a toothbrush reforming apparatus 40 of the fifth embodiment is comprised of a toothbrush supporting body 41, a binding body 42, and a support position-adjusting member 43 for attachment to the toothbrush supporting body 41, as shown in FIG. 13(A). The toothbrush supporting body 41 has a structure substantially the same as that of the toothbrush supporting body 2 comprising the toothbrush reforming apparatus 1 of the first embodiment, and an attachment piece 41*b* formed at a rear side of a supporting portion 41*a* and formed slightly lower than a top surface of the supporting portion 41*a* (the constitutions other than the attachment piece 41*b* are the same as those of the toothbrush reforming apparatus 1 of the first embodiment). Meanwhile, the support position-adjusting member 43 has a side thereof molded into a rectangular C letter shape, and is comprised of: one supporting surface 43*a* supporting a brush portion of a toothbrush and serving as a top surface (serving as a bottom surface when turned upside-down as described afterwards) of the support position-adjusting member 43; one supporting panel portions 43*b*; a downward extending portion 43*c* extending downward from a proximal end of the one supporting panel portion 43*b*; and other supporting panel portion 43*d* formed below the one supporting panel portions 43*b*, molded with the same width as the one supporting panel portion 43*b*, and molded with a thickness thinner than that of the one supporting panel portion 43*b*. An insertion space is formed with a size substantially the same as the thickness of the supporting portion 41*a* of the toothbrush supporting body 41 and the thickness of the attachment piece 41*b*, and is formed between the one supporting panel portion 43*b* and the other supporting panel portion 43*d*. It is now to be noted that a bottom surface of the other supporting panel portion 43*d* serves as the other supporting surfaces (numeral abbreviated) when the support position-adjusting member 43 is turned upside-down as described afterwards.

Therefore, according to the brush reforming apparatus 40 of the fifth embodiment, the surface for supporting the brush portion of the toothbrush can be positioned higher than the top surface of the supporting portion 41*a* by attaching the support position-adjusting member 43 to the toothbrush supporting body 41 in a manner where the one supporting surface 43*a* is arranged as the top surface of the support position-adjusting member 43, as shown in FIG. 13(B). On the other hand, the brush portion of the toothbrush can be supported at a surface higher than the top surface of the supporting portion 41*a* and lower compared to when the support position-adjusting member 43 is attached to the toothbrush supporting body 41 in a manner where the one supporting surface 43*a* is arranged as the top surface of the support position-adjusting member 43. Further, the support position-adjusting member 43 can be attached to the attachment piece 41*b* when the support position-adjusting member 43 is unnecessary for use. This prevents loss of the support position-adjusting member 43. It is now to be noted that the support position-adjusting member 43 can also be attached to the brush reforming apparatus 10 of the second embodiment, as shown in FIG. 13(C). In such case, an attachment piece 11*h* is to be formed on the opposite side of the supporting portion 11*a* of the brush reforming apparatus 10, and the support position-adjusting member 43 is to be attached to the attachment piece 11*h* when not required for use. This structure also allows support position adjustment of a brush portion for a toothbrush having different height and enables easy and secure binding of the bristles.

Figure 14:
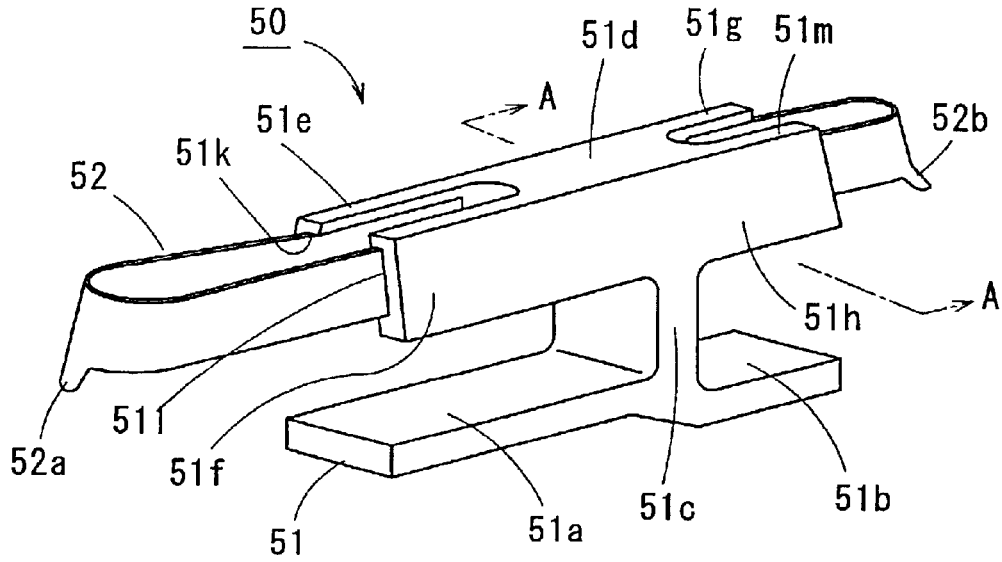
FIG. 14 is a perspective view showing a toothbrush reforming apparatus of the sixth embodiment.

Next, a sixth embodiment of a brush reforming apparatus 50 for a toothbrush will be explained in detail with reference to the drawings. The brush reforming apparatus 50 of the sixth embodiment has a characteristic of being capable of supporting the brush portion of a toothbrush not only from a front side but also from a rear side. The brush reforming apparatus 50 has a binding body supporting body 51 and an endless binding body 52, as shown in FIG. 14. The toothbrush supporting body 51 is integrally molded with synthetic resin, wood, hard rubber, or metal, and is comprised of one supporting portion 5*a* formed at a front side thereof for supporting a brush portion, other supporting portion 51*b* formed on the opposite side (rear side) of the supporting portion 51*a* and formed with a top surface being arranged slightly below the supporting portion 51*a*, an erect portion 51*c* erected upward and formed integral with a proximal end of the supporting portion 51*a* at a front side thereof and integral with a proximal end of the supporting portion 51*b* at a rear side thereof, and a binding body supporting portion 51*d* formed on a top end of the erect portion 51*c*. The binding body supporting portion 51*d* has a plane shape molded as a substantially H-letter shape, has a first guiding panel portion 51*d* formed at a front-left side thereof, a second guiding panel portion 51*e* formed at a front-right side thereof and faced against the first guiding panel portion 51*d*, a third guiding panel portion 51*g* formed at a rear-left side thereof, a fourth guiding panel portion 51*h* formed at a rear-right side thereof and faced against the third guiding panel portion 51*g*, and has a block portion (numeral abbreviated) formed at the proximal ends of the first guiding panel portion 51*e* to the fourth guiding panel portion 51*h*.

Figure 15:
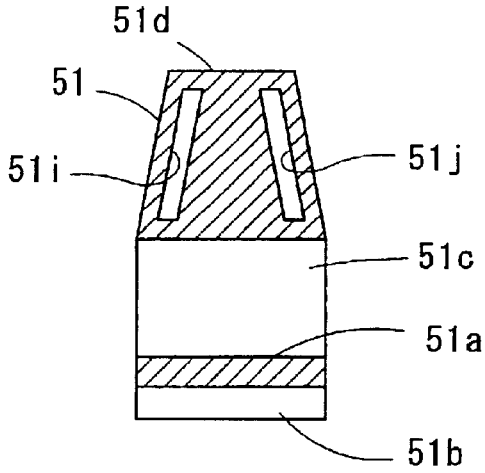
FIG. 15 is a cross-sectional view along line A—A.
Figure 16:
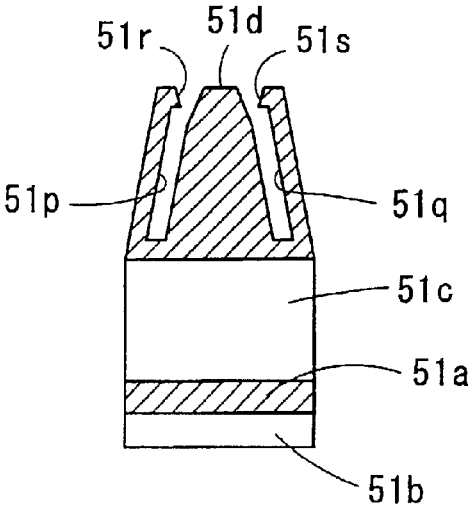
FIG. 16 is a cross-sectional view showing a varied example of the toothbrush reforming apparatus shown in FIG. 14.

The block portion has a left elongated slot 51*i* and a right elongated slot 51*j* formed thereto as shown in FIG. 15, in which the left elongated slot 51*i* and the right elongated slot 51*j* form a substantially upside-down V letter shape becoming gradually separated further downward. A first guiding groove portion 51*k* is formed at an inner side of the first guiding panel portion 51*e*, a second guiding groove portion

51*l* is formed at an inner side of the second guiding panel portion 51*f*, a third guiding groove portion 51*m* is formed at an inner side of the third guiding panel portion 51*g*, and a fourth guiding groove portion (not shown) is formed at an inner side of the fourth panel portion 51*h*, as shown in FIG. 14. The endless binding body 52, as shown in FIG. 14, is formed from a belt member (not shown), which is molded into a belt-like shape and welded at both ends. The endless binding body 52 is inserted through the left guiding elongated slot 51*i*, the first guiding groove portion 51*k*, the right guiding elongated slot 51*j*, the second guiding groove portion 511, the right guiding elongated slot 51*j*, a fifth guiding groove portion (not shown), and the guiding groove portion 51*m*, and allows the toothbrush supporting body 51 to move in a frontward direction as well as a rearward direction. It is now to be noted that the front side and the rear side of the endless binding body 52 are both bent into an arc-like shape and have a pressing portion 52*a*, 52*b* formed at a lower end, respectively.

Therefore, according to the toothbrush reforming apparatus 50 of the sixth embodiment, the brush portion of a toothbrush can be supported at the top surface of the one supporting portion 51*a* to bind the brush of the brush portion at the front side of the endless binding body 52, and the brush portion of a toothbrush can also be supported at the top surface of the other supporting portion 51*b* to bind the brush of the brush portion at the rear side of the endless binding body 52. Accordingly, the toothbrush reforming apparatus 50 of the sixth embodiment is capable of reforming regardless of the width of the brush portion of the toothbrush since erect portion 2*b*, 2*c* as in the toothbrush reforming apparatus of the first embodiment is not formed thereto, and is also capable of reforming a variety of toothbrushes by using the supporting portion 51*a* when the length (height) of the brush is short and using the other supporting portion 51*b* when the length (height) of the brush is long. It is now to be noted that the toothbrush reforming apparatus 50 of the sixth embodiment can be applied to a further variety of toothbrushes by using the support position-adjusting member 43. According to the toothbrush reforming apparatus 50 of the sixth embodiment, the toothbrush supporting body 51 has the left elongated slot 51*i* and the right elongated slot 51*j* formed thereto, in which the endless binding body 52 is inserted through the left elongated slot 51*i* and the right elongated slot 51*j*. However, the toothbrush supporting body 51 can have a left elongated slot 51*p* and a right elongated slot 51*q* formed thereto, in which the endless binding body 52 is inserted through the left elongated slot 51*p* and the right elongated slot 51*q*. In such case, the left elongated slot 51*p* and the right elongated slot 51*q* have a check claw 51*r*, 51*s* formed at an upper end of an inner wall thereof for preventing the inserted endless binding body 52 from dislodgement. With such structure, the endless binding body 52 can be engaged with ease.

Figure 17:
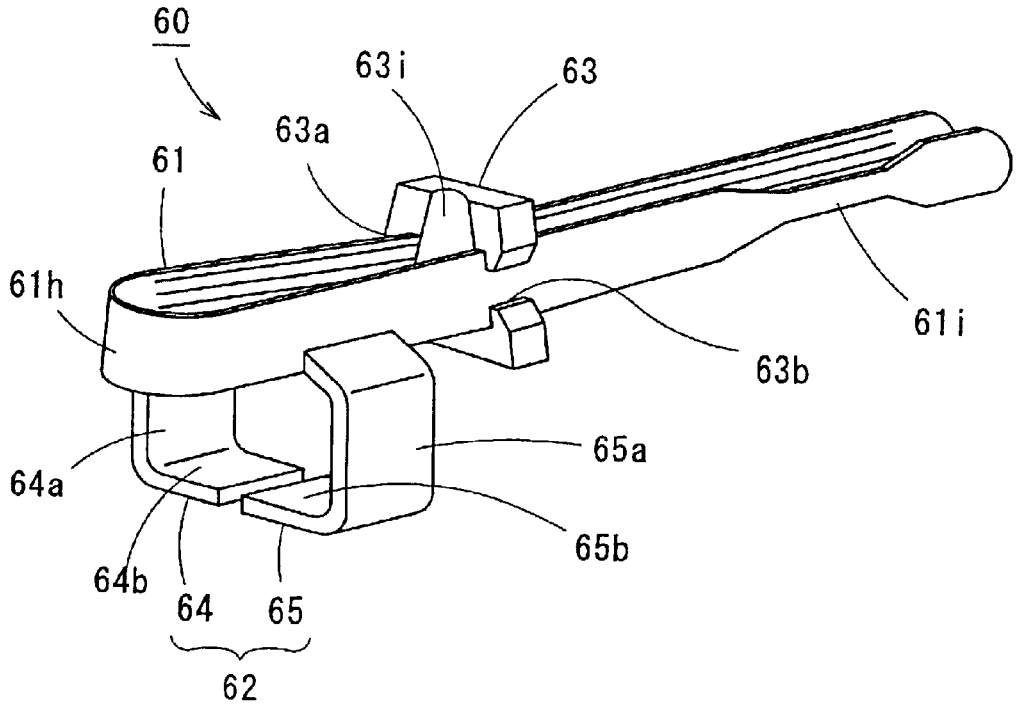
FIG. 17 is a perspective view showing a toothbrush reforming apparatus of the seventh embodiment.
Figure 18:
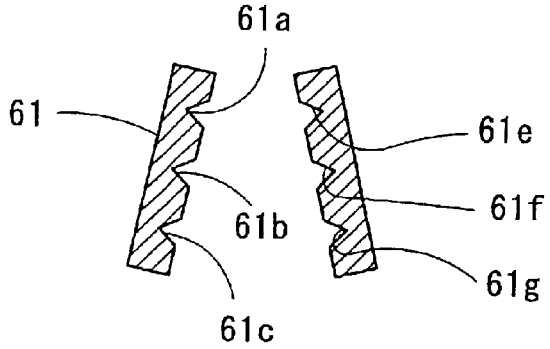
FIG. 18 is a cross-sectional view of a binding body.

Next, a seventh embodiment of a brush reforming apparatus 60 for a toothbrush will be explained in detail with reference to the drawings. The brush reforming apparatus 60 of the seventh embodiment is comprised of a binding portion 61 molded into a belt-like shape, a supporting portion 62 for supporting a bottom surface of a brush portion of a toothbrush, and a moving member 63, as shown in FIG. 17. The binding portion 61 is a synthetic resin molded into a substantially U letter shape or a V letter shape, and has three recesses 61*a*, 61*b*, 61*c*, 61*e*, 61*f*, 61*g* formed on each opposing side thereof, as shown in FIG. 18. The binding portion 61 has an arc-like portion 61*h* bent into an arc shape at a front side thereof, and is opened at a rear side thereof. The binding portion 61 has a narrow-width portion 61*i* formed at a midsection thereof for detachment from the moving member 63 (described afterwards).

In the toothbrush reforming apparatus 60, a left supporting portion 64 and a right supporting portion 65 arranged facing the left supporting portion 64 are formed at a midsection proximal to the arc-like portion 61*h* of the binding portion 61. Further, in the toothbrush reforming apparatus 60, the left supporting portion 64 and the right supporting portion 65 forms the supporting portion 62. The left supporting portion 64 is comprised of a left downward extending portion 64*a* having a top end thereof extending downward from a bottom surface of the midsection of the binding portion 61, and a left supporting panel portion 64*b* bent substantially perpendicular to a bottom end of the left downward extending portion 64*a* for supporting the brush portion. The right supporting portion 65 is formed symmetrically to the left supporting portion, and is comprised of a right downward extending portion 65*a* having a top end thereof extending downward from a bottom surface of the midsection of the binding portion 61, and a right supporting panel portion 65*b* bent substantially perpendicular to a bottom end of the right downward extending portion 65*a* for supporting the brush portion. It is now to be noted that a tip of the left supporting panel portion 64*b* and a tip of the right supporting panel portion 65*b* are slightly spaced to enable widening in a left-right direction in correspondence to widening of the opposing midsection of the binding body 61.

Figure 19:
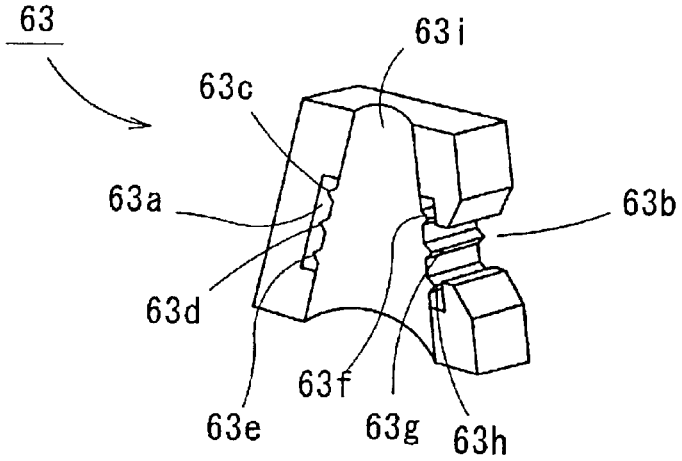
FIG. 19 is a perspective view showing a moving member.

As shown in FIG. 19, the moving member 63 is molded into a planar shape, and has an elongated slot 63*a* for insertion of one side of the binding body 61 at a left side thereof, and a groove portion 63*b* with an opening (numeral abbreviated) having a width substantially the same as that of the narrow-width portion 61*i* of the binding body 61 at a right side thereof. It is now to be noted that the length of both the elongated slot 63*a* and the groove portion 63*b* correspond to the width of the binding portion 61, and an inner wall of the elongated slot 63*a* and the groove portion 63*b* are formed with protrusions 63*c*, 63*d*, 63*e*, 63*f*, 63*g*, 63*h* for insertion to the three recesses 61*a*, 61*b*, 61*c*, 61*e*, 61*f*, 61*g* of the binding body 61. The moving member 63 has a front surface formed with an arc-like recessed groove 63*i*.

Consequently, according to the toothbrush reforming apparatus 60 of the seventh embodiment, first, one side of the binding body 61, which is bent at the center, that is, at the arc-like portion 61*h* and has a midsection facing each other, is detached from the groove portion 63*b* formed in the moving member 63; both ends of the binding body 61 is slightly widened; then maintaining such state, the distal end of a brush portion of a toothbrush is supported upon the supporting portion 62 comprised of the left supporting portion 64 and the right supporting portion 65 so as to place the brush of the brush portion into the binding portion 61. Subsequently, the one side of the binding body 61 detached from the moving member 63 is reattached in a manner shown in FIG. 17, and then, the moving member 63 is moved in a direction to the front side. Accordingly, the brush can be bound by the binding body 61 and the moving member 63. Therefore, the toothbrush reforming apparatus 60 having the foregoing structure can also easily bind a brush of a toothbrush.

Figure 20:
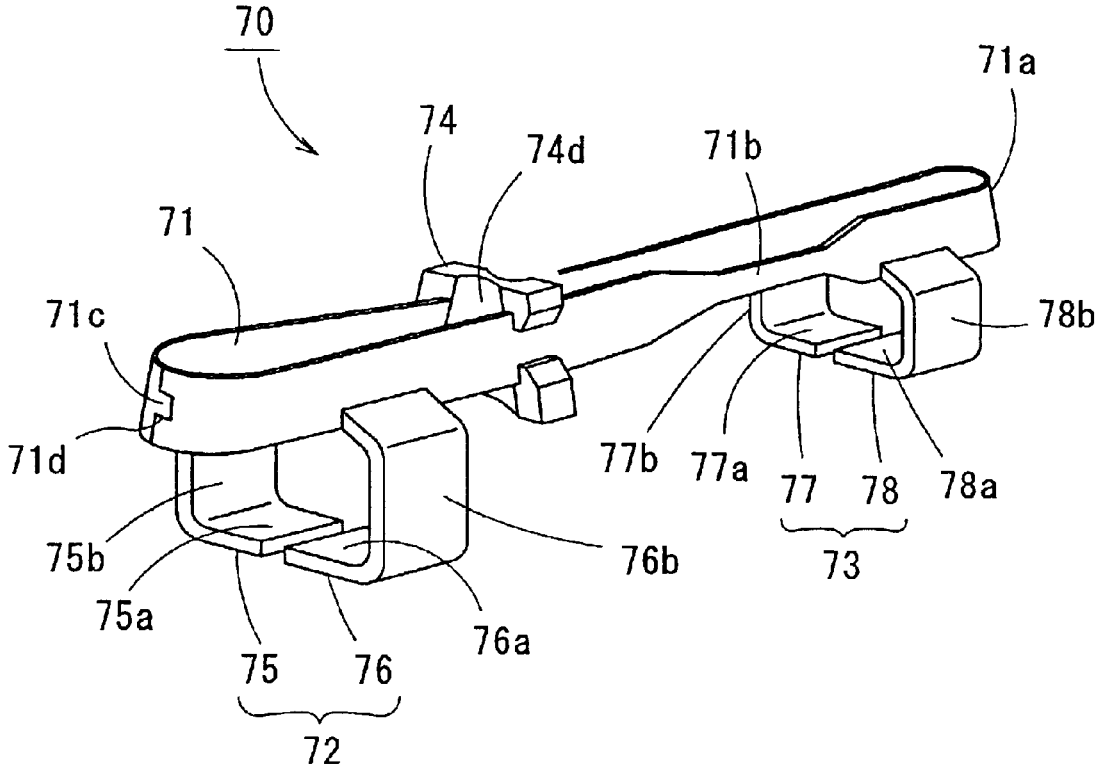
FIG. 20 is a perspective view showing a toothbrush reforming apparatus of the eighth embodiment.
Figure 23:
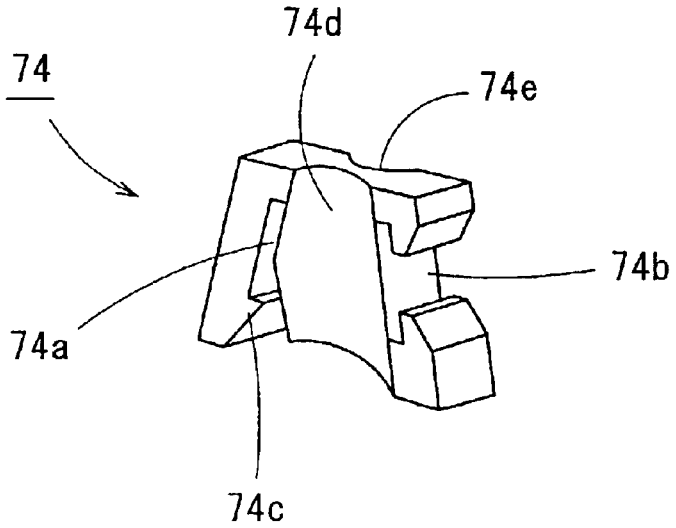
FIG. 23 is a perspective view showing a moving member.
Figure 21:
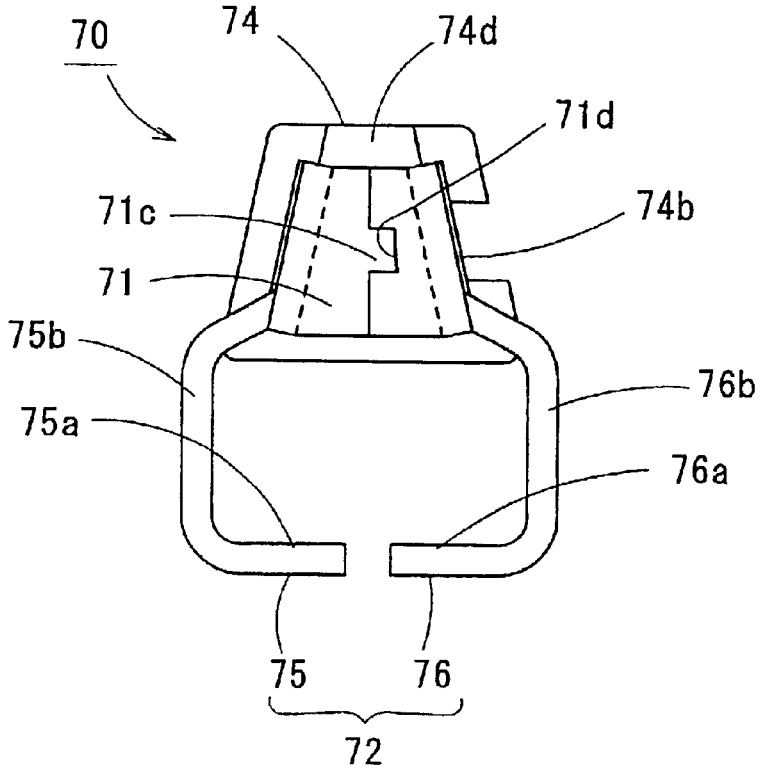
FIG. 21 is a front view of the toothbrush reforming apparatus shown in FIG. 20.
Figure 22:
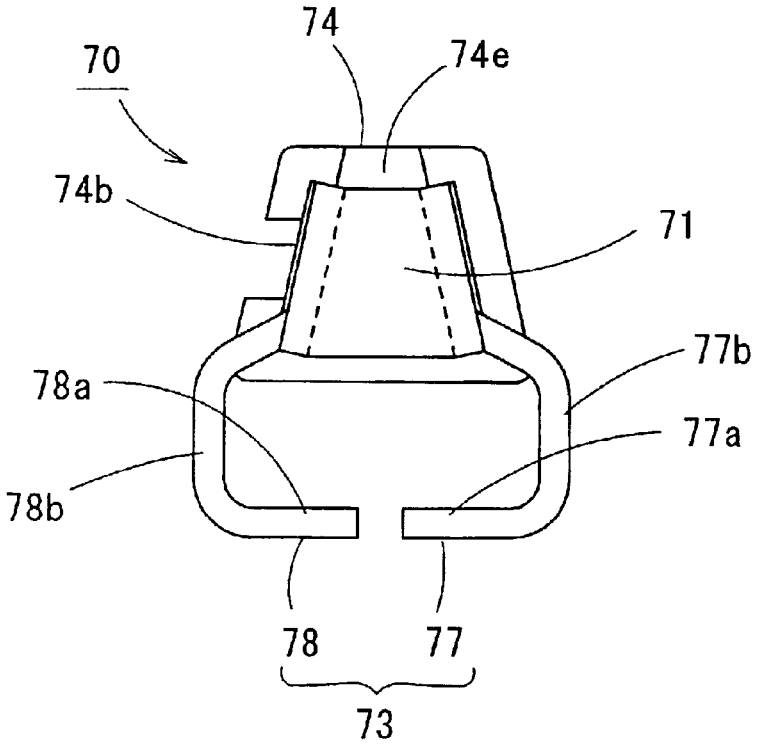
FIG. 22 is a rear view of the toothbrush reforming apparatus shown in FIG. 20.

Although the toothbrush reforming apparatus 60 of the seventh embodiment has been described with having the supporting portion 62 formed only at the front side of the binding portion 61 for supporting the brush portion of the toothbrush, the supporting portion of this invention is not to be restricted to be singularly formed, but could also be formed as two supporting portions, as a toothbrush reforming apparatus 70 of an eighth embodiment shown in FIG. 20. That is, the toothbrush reforming apparatus 70 of the eighth embodiment is comprised of a belt-like binding portion 71 molded into a belt-like shape, bent at a center, that is, at an arc-like portion 71*a* of a rear side to become shaped into a substantially U letter or V letter form, and formed with both ends thereof positioned at a front side; a first supporting portion 72 formed at a midsection of the binding portion 71 on the front side; a second supporting portion 73 formed at the midsection on the rear side; and a moving member 74. In the binding portion 71, a narrow-width portion 71*b* is formed at a midsection on the rear side as in the toothbrush reforming apparatus 6 of the seventh embodiment; a midsection of one end of the binding portion 71 is molded into an arc shape; and a protrusion 71*c* is formed on the one end thereof. In the same manner, a midsection of the other end of the binding portion 71 is molded into an arc shape, and a recess 71*d* is formed on the other end thereof for insertion with the protrusion 71*c*. As shown in FIG. 21, the first supporting portion 72 is comprised of a left supporting portion 75 and a right supporting portion 76 in the same manner as the supporting portion 62 of the seventh embodiment, and the second supporting portion 73 is comprised of a left supporting portion 77 and a right supporting portion 78, as shown in FIG. 23. It is now to be noted that a detail description of the first supporting portion 72 and the second supporting portion 73 shall be omitted since the first supporting portion 72 and the second supporting portion 73 have a structure basically the same as that of the supporting portion 62 of the toothbrush reforming apparatus 60 in the seventh embodiment. However, in the toothbrush reforming apparatus 70 of the eight embodiment, the position of the top surfaces (supporting position for the brush portion) of the left and right supporting panel portions 75*a*, 76*a* of the first supporting portion 72 are formed lower than the top surfaces of the left and right supporting panel portions 77*a*, 78*a* of the second supporting portion 72, as shown in FIG. 20.

As shown in FIG. 23, the moving member 74 is molded into a substantially planar shape, and has an left groove portion 74*a* for insertion of one side of the binding body 71 at a left side thereof, and a groove portion 74*b* with an opening (numeral abbreviated) having a width substantially the same as that of the narrow-width portion 71*b* of the binding body 71 at a right side thereof. It is now to be noted that the left groove portion 74*a* has an opening formed at a lower portion thereof, and a check claw formed at bottom edge of the inner wall thereof. Further, the moving member 74 has a front recessed groove 74*d* formed extending from top to bottom at the front of the moving member 74, and a rear recessed groove 74*a* formed at the rear of the moving member 74.

Figure 24:
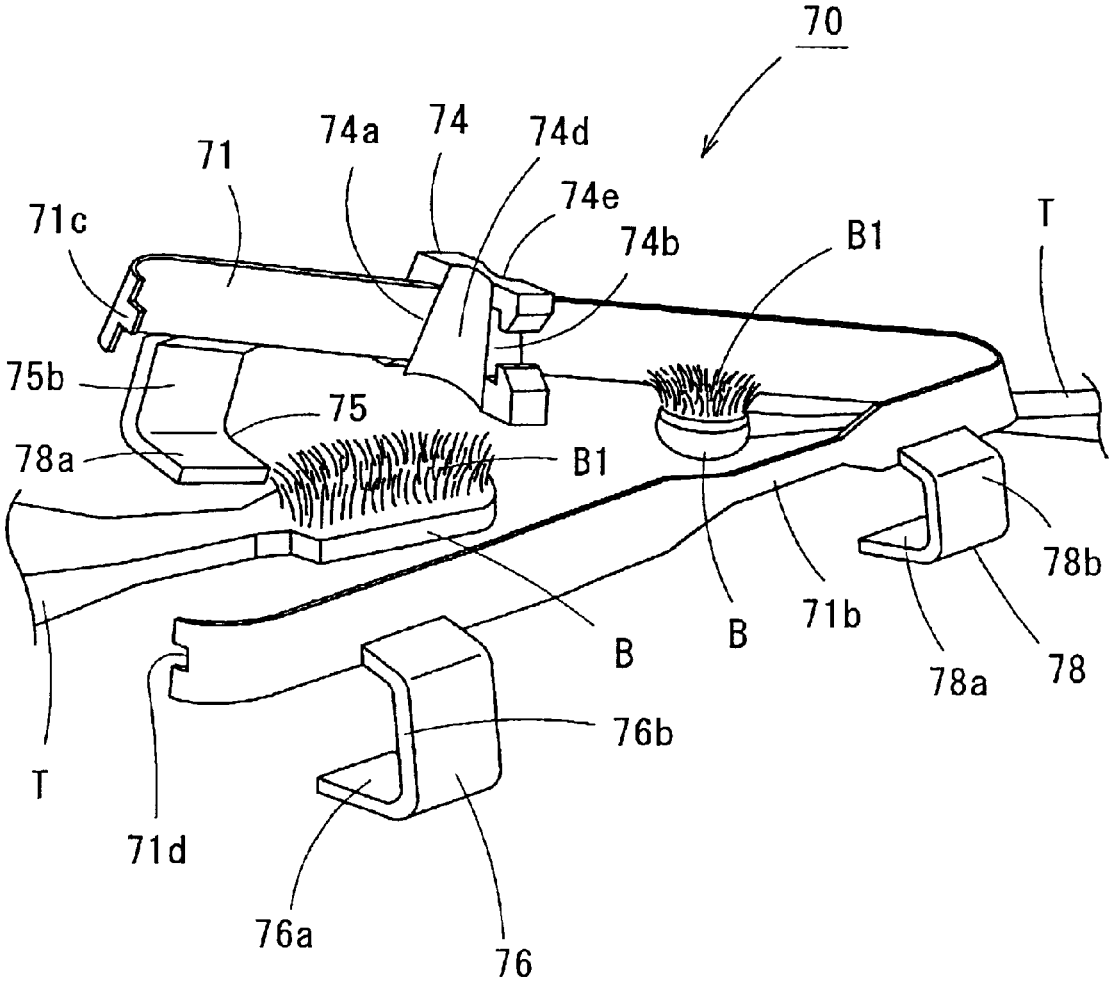
FIG. 24 is a perspective view showing a method of using the toothbrush reforming apparatus shown in FIG. 20.

Consequently, according to the toothbrush reforming apparatus 70 of the eighth embodiment, the midsection of the binding body 71 is detached from the moving member 74 through the narrow-width portion 71*b*; the brush portion is then inserted either from the front side [when reforming a long (tall) brush B1] or the rear side [when reforming a short (short) brush B1 ] in state a where the front side is open, as shown in FIG. 24; the midsection of the binding body 71 is then inserted again through the right groove portion 74*b* of the moving member 74; and the moving member 74 is then moved either toward the front side or the rear side so that each of the brushes B1 of the brush portions B of the toothbrushes can be bound. That is, the toothbrush reforming apparatus 70 of the eight embodiment can also provide secure binding with a single toothbrush reforming apparatus 70 for a toothbrush T having a long brush B1 as well as a tooth brush T having a short brush B1 (e.g. an electric toothbrush).

Figure 25:
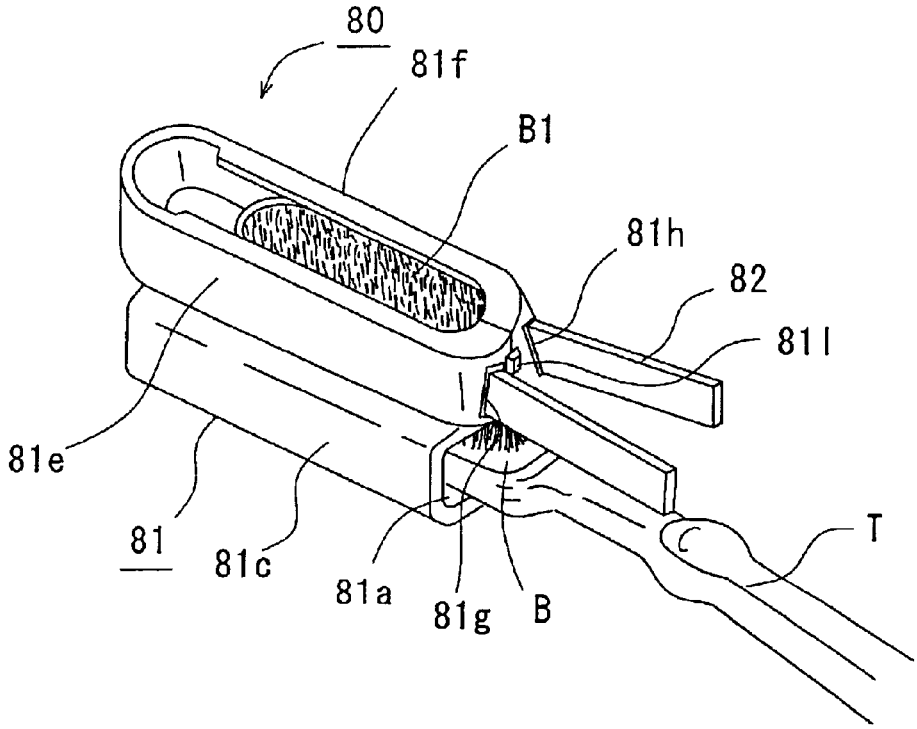
FIG. 25 is a perspective view showing a toothbrush reforming apparatus of the ninth embodiment.
Figure 26:
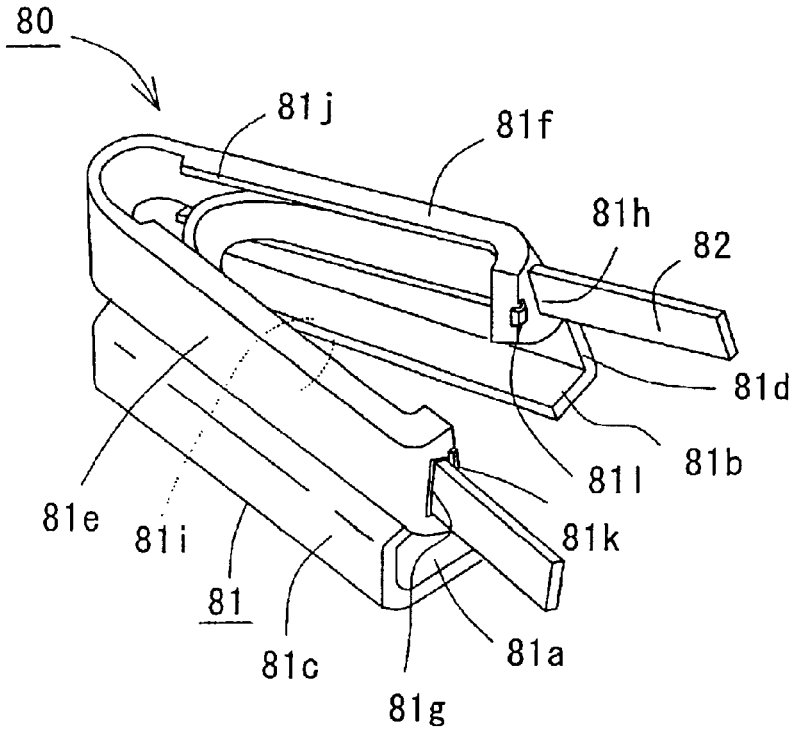
FIG. 26 is a perspective view showing a state prior to the use of the toothbrush reforming apparatus shown in FIG. 25.

Next, a ninth embodiment of a brush reforming apparatus 80 for a toothbrush will be explained in detail with reference to the drawings. The toothbrush reforming apparatus 80 of the ninth embodiment is comprised of a toothbrush supporting body 81 having a plane shape molded into a V letter form, and a binding body 82 molded into a belt-like shape, as shown in FIG. 25. The toothbrush supporting body 81 has a front side being in an open state and being molded with a plane shape of a V letter shape, in which the lower portion of the toothbrush supporting body 81 includes a left supporting portion 81*a* for supporting substantially the left half of a bottom surface of a brush portion of a toothbrush when the front side is in a closed state (as described afterwards), a right supporting portion 81*b* for supporting substantially the right half of a bottom surface of the brush portion when the front side is in a closed state, a left erect portion 81*c* erected upward from a left end of the left supporting portion 81*a*, a right erect portion 81*d* erected upward from a right end of the right supporting portion 81*b*, a left binding body supporting portion 81*e* formed at a top end of the left erect portion 81*c* for supporting a midsection of the binding body 82, and a right binding body supporting portion 81*f* formed at a top end of the right erect portion 81*d* for supporting a midsection of the binding body 82.

A left guiding elongated slot 81*g* is formed at a front side of the left binding body supporting portion 81*e* for inserting the binding body 82 therethrough, and a right guiding elongated slot 81*h* is formed at a front side of the right binding body supporting portion 81*f* for inserting the binding body 82 therethrough. A left groove portion 81*i* is formed at an inner surface of the left binding body supporting portion 81*e* for guiding the binding body 82, and a right groove portion 81*j* is formed at an inner surface of the right binding body supporting portion 81*f* for guiding the binding body 82. Further, one engagement portion 81*k* is formed at a front surface of the left binding body supporting portion 81*e*, and the other engagement portion 811 is formed at a front surface of the right binding body supporting portion 81*f* for engaging with the one engagement portion 81*k*. Accordingly, the toothbrush supporting body 81, which had been in an opened state and in a substantially V letter shape, is closed by engaging the one engagement portion 81*k* to the other engagement portion 811. When the front side of the toothbrush supporting body 81 is in an opened state, the binding body 82 is correspondingly opened and molded into a substantially V letter shape, has a center bent into a arc-like shape, has a midsection of one end inserted through the left elongated slot 81*g* and along through the left groove portion 81*i*, and has a midsection of the other end inserted through the right elongated slot 81*h* and along through the right groove portion 81*j*. It is now to be noted that both ends of the binding body 82 are free ends without being fixed by a metal fitting 4 as in the binding body 3 of the toothbrush reforming apparatus 1 in the first embodiment.

According to the toothbrush reforming apparatus 80 of the ninth embodiment, a brush portion B of a toothbrush T is inserted from a front side in a state where the front side is opened, and the one engagement portion 81*k* and the other engagement portion 811 are then engaged to each other for closing the front side of the toothbrush reforming apparatus 80. Accordingly, the brush portion B of the toothbrush T is supported by the left supporting body 81*a* and the right supporting body 81*b*. In such state, the brush is gradually bound at the center of the binding body 82 (portion bent in a arc-like shape) by drawing forth both ends of the binding body 82. The brush can be completely bound when the binding body 82 to is drawn forth to a prescribed length. Therefore, the toothbrush reforming apparatus 80 having the foregoing structure can also easily and securely bind a brush B1 of a toothbrush.

Figure 27:
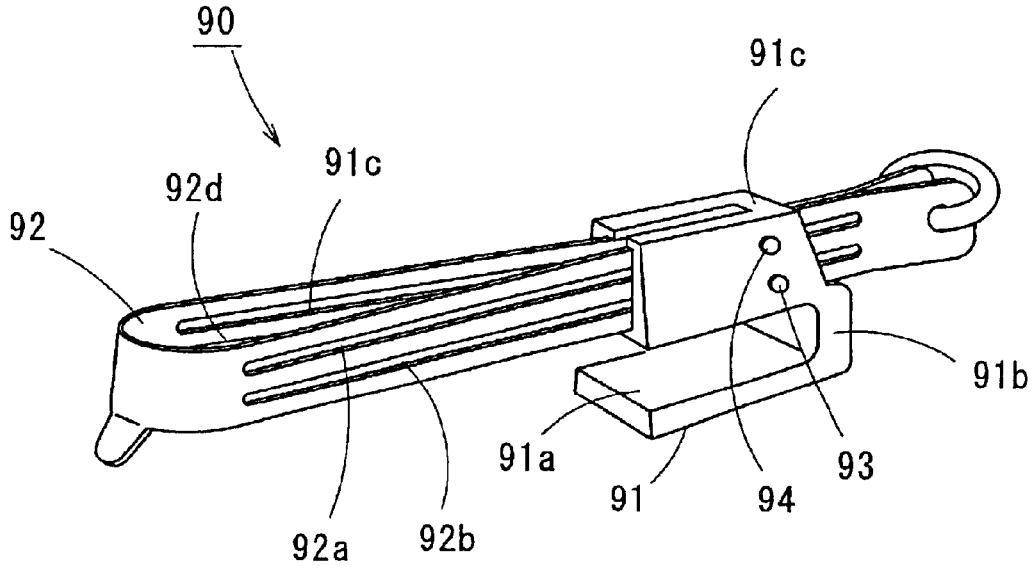
FIG. 27 is a perspective view of a toothbrush reforming apparatus of the tenth embodiment.
Figure 28:
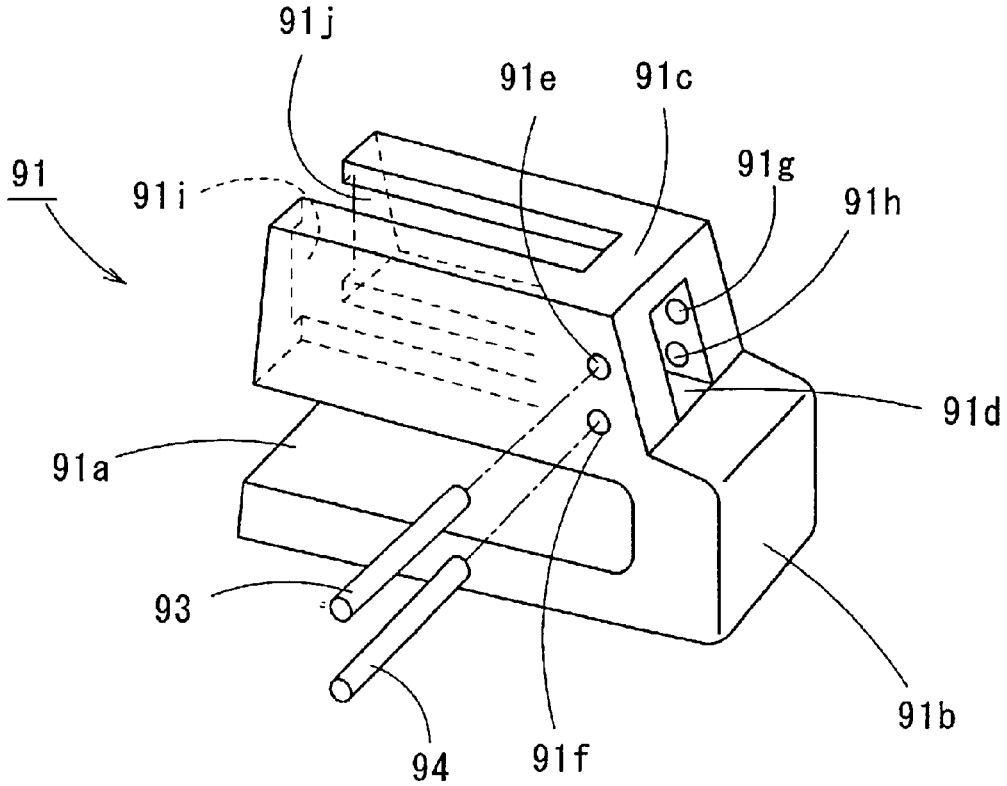
FIG. 28 is a exploded perspective view of a toothbrush supporting body comprising the toothbrush reforming apparatus shown in FIG. 27.

Next, a tenth embodiment of a brush reforming apparatus 90 for a toothbrush will be explained in detail with reference to the drawings. The toothbrush reforming apparatus 90 of the tenth embodiment has a characteristic of having a single guiding elongated slot (described afterwards) formed to a toothbrush supporting body 91. That is, the toothbrush reforming apparatus 90 is comprised of the toothbrush supporting body 91 and a belt-like binding body 92, as shown in FIG. 27. As the toothbrush reforming apparatus 10 of the second embodiment as shown in FIG. 5, the toothbrush supporting body 91 is comprised of a supporting portion 91 for supporting a brush portion of a toothbrush, a rear side erect portion 91*b* erect upward from the rear side of the supporting portion 91*a*, and a binding body supporting portion 91*c* formed at a top end of the rear side erect portion 91*b*. However, as shown in FIG. 28, the binding body supporting portion 91*c* has a single guiding elongated slot being formed thereto and has two stoppers 93, 94 fixed thereto, in which the stoppers 93, 94 are molded into a rod-like shape for preventing the brush from being caught in the binding body 92 (described afterwards). The stoppers 93, 94 are inserted through insertion apertures 91*e*, 91*f*, 91*g*, 91*h* formed on both side surfaces of the toothbrush supporting body 91. It is now to be noted that the binding body 92 of the toothbrush supporting body 91 also has guiding groove portions 91*i*, 91*j* formed thereto, as the toothbrush reforming apparatus 10 of the second embodiment. The binding body 92 is structured basically the same as the binding body 3 of the toothbrush reforming apparatus 10 of the second embodiment except for including elongated slots 92*a*, 92*b*, 92*c*, 92*d* formed from the bent, arc-like shaped distal end to the proximal end for insertion of the two stoppers 93, 94.

In the same manner as the toothbrush reforming apparatus (numeral abbreviated) of each of the aforementioned embodiments, the toothbrush reforming apparatus 90 of the tenth embodiment having a single guiding elongated slot 91*d* formed thereto can also provide easy and quick binding of a brush of a brush portion. Further, with the toothbrush reforming apparatus 90, the two stoppers 93, 94 can effectively prevent the bristles of the brush from being caught between the binding body 92 and the binding body 92 when the brush of the brush portion is bound by pulling the binding body 92. It is now to be noted that the stoppers 93, 94 are not necessarily required to be dually arranged to the toothbrush supporting body, and that a single stopper (not shown) can also be arranged thereto.

Consequently, the toothbrush reforming apparatus (numeral abbreviated) of the aforementioned embodiments can provide extremely easy and secure binding of a brush B1 formed at a brush portion B of a toothbrush T. More particularly, each of the toothbrush reforming apparatuses (numeral abbreviated) can provide reformation regardless of the length of the targeted brush portion B and can also easily reform the electric toothbrush used in recent years with a plane shape of a circular shape owing to the structure thereof using a movable binding body, an endless binding body, or a moving member.

Although the portions in the above description for each of the embodiments formed at the toothbrush supporting body for inserting the binding body or the endless binding body therethrough are all formed as the elongated slot and the groove portion, it is possible for this invention to have at least one of either the elongated slot or the groove portion. Although a single elongated slot 91*d* (see FIG. 28) is formed in the toothbrush supporting body 91 for inserting the binding body 92 therethrough in respect of the toothbrush reforming apparatus 90 of the tenth embodiment, such portion for insertion of the binding body 92 is not necessarily required to be formed as the elongated slot 91*d*, but can also be a groove portion formed extending from top to bottom thereof. Likewise, the elongated slot (numeral abbreviated) comprising the toothbrush reforming apparatus 1, 10, 20, 30, 40 of the first, second, third, and fourth embodiment can instead be altered to a groove portion formed extending from top to bottom of each binding body supporting portion (numeral abbreviated). A binding body or an endless binding body can easily be attached to a toothbrush supporting body by altering to such groove portion.

Industrial Applicability

As apparent from the above description of each embodiment of this invention, according to the first invention (invention described in claim 1), a distal end of a toothbrush is supported by a supporting portion formed to a toothbrush supporting body, and a binding body is moved in a direction toward the distal end of the toothbrush or in a direction opposite from the distal end of the toothbrush, thereby, a brush portion of a toothbrush is bound by the binding body. Accordingly, the first invention can bind a brush with extreme ease and quickness, and can provide binding whether a brush portion of a toothbrush is long or short. In a state where a brush is bound by the toothbrush reforming apparatus, a method, for example, in which the toothbrush reforming apparatus is applied with boiled water or steeped into hot water, and then cooled by cold water or the like, can reform the brush into an ideal state.

According to the second invention (invention described in claim 2), a toothbrush supporting body is formed with one supporting portion for supporting a distal end of a toothbrush and another supporting portion also for supporting the distal end of the toothbrush, the one supporting portion and the other supporting portion are formed different in terms of the height for providing support, and a belt-like endless binding body is provided as a component of the invention, thereby, the second invention is not only able to reform a brush portion of various length as in the first invention, but is also able to reform a brush portion having a brush (bristles) of various height, in which the distal end of a toothbrush is supported by selecting either the one supporting portion or the other supporting portion for providing secure reformation. It is now to be noted that a brush for an electric toothbrush can also be reformed by forming the height of the one supporting portion or the other supporting portion in correspondence with the length of the brush of the electric toothbrush.

According to the third invention (invention described in claim 3), a toothbrush supporting body, which has a supporting member and a binding body supporting member being separated from each other, is formed to be variably adjustable by arranging a supporting portion of the supporting member proximal to or distal to one or two guiding groove portions or a guiding elongated slot, thereby, as in the same manner as the second invention, the third invention is also able to reform a brush portion having a brush (bristles) of various height, in which the distal end of a toothbrush is supported by selecting either the one supporting portion or the other supporting portion for providing secure reformation.

According to the fourth invention (invention described in claim 4), a distal end of a toothbrush is inserted from an open side of an opened toothbrush supporting body; the opened side of the toothbrush supporting body is then closed, and a belt-like binding body is then operated to a direction opposite from the distal end of the toothbrush, thereby, a brush (bristles) of the toothbrush can be bound. Accordingly, as in the same manner as the first invention, this fourth invention can also provide secure binding of a brush.

According to the fifth invention (invention described in claim 5), one or two guiding groove(s) or the one or two guiding elongated slot(s) has or have an arc-like or wave-like shape in which the binding body or the endless binding body is inserted therethrough, or the one or two guiding groove(s) or the one or two guiding elongated slot(s) has a protrusion formed at a wall thereof or the toothbrush supporting body has a horizontal rod formed at a front surface thereof and the binding body or the endless binding body has a recessed groove or an elongated slot formed thereto to allow insertion of the protrusion or the horizontal rod through the recessed groove or the elongated slot, thereby, the fifth invention prevents the bristles of a brush from being caught into the guiding groove or the guiding elongated slot in operating with the binding body or the endless binding body and provide secure reformation.

According to the sixth invention (invention described in claim 6), a moving member moves in association with the binding body for binding the brush; accordingly, the thus structured invention can also provide secure binding of a brush.

What is claimed is:

1. A brush reforming apparatus for a toothbrush comprising:

a toothbrush supporting body having;

a supporting portion supporting at least a bottom surface of a distal end of a toothbrush; and one or two guiding groove portion(s) or one or two guiding elongated slot(s) being formed above the distal end of the toothbrush supported by the supporting portion; and a binding body having a belt-like shape, the binding body being inserted through the one or two guiding groove portion(s) or the one or two guiding elongated slot(s), and the binding body being bent at a center of the binding body into a U letter, a V letter, or a rectangular C letter shape.

2. A brush reforming apparatus for a toothbrush comprising:

a toothbrush supporting body having;

one supporting portion supporting at least a bottom surface of a distal end of a toothbrush;

other supporting portion being formed opposite to a position where the one supporting portion is formed, the other supporting portion supporting at least the bottom surface of the distal end of the toothbrush, and the other supporting portion supporting from at a position above or below a supporting position of the one supporting portion; and one or two guiding groove portion(s) or one or two guiding elongated slot(s) being formed between the one supporting portion and the other supporting portion, and being formed above the distal end of the toothbrush supported by the one supporting portion or the other supporting portion; and an endless binding member having a belt-like shape and being inserted through the one or two guiding groove portion(s) or the one or two guiding elongated slot(s).

3. The brush reforming apparatus for a toothbrush according to claim 1 or 2.

wherein the toothbrush supporting body has a supporting member formed with a supporting portion supporting at least a bottom surface of a distal end of the toothbrush, and a binding body supporting member being attachable to the supporting member while having the one or two guiding groove portion(s) or the one or two guiding elongated slot(s) formed thereto; and wherein the supporting member and the binding body supporting member are attached variably and adjustably for arranging a position of a supporting portion formed in the supporting member and a position of the one or two guiding groove portion(s) or the one or two guiding elongated slot(s) separate from or proximate to each other.

4. A brush reforming apparatus for a toothbrush comprising:

a toothbrush supporting body having;

a supporting portion having a plane shape molded into a substantially V letter shape, the supporting portion having an open side thereof being closable, the supporting portion supporting a bottom surface of a distal end of a toothbrush during a closed state;

one guiding groove portion or one guiding elongated slot formed on one side of the open side;

other guiding groove portion or other guiding elongated slot formed on the other side of the open side; and a binding body having a belt-like shape, the binding body being bent at a center thereof into an arc-like shape; the binding body having a midsection on one end thereof for insertion through the one guiding groove portion or the one guiding elongated slot; and the binding body having a midsection on the other end thereof for insertion through the other guiding groove portion or the other elongated slot.

5. The brush reforming apparatus for a toothbrush according to claim 1, 2, or 4, wherein the one or two guiding groove(s) or the one or two guided elongated slot(s) has or have an arc-like or wave-like shape in which the binding body or the endless binding body is inserted therethrough, or the one or two guiding groove(s) or the one or two guiding elongated slot(s) has a protrusion formed at a wall thereof or the toothbrush supporting body has a horizontal rod formed at a front surface thereof and the binding body or the endless binding body has a recessed groove or an elongated slot formed thereto to allow insertion of the protrusion or the horizontal rod through the recessed groove or the elongated slot.

6. A brush reforming apparatus for a toothbrush comprising:

a binding body or an endless binding body having a belt-like shape, and a midsection bent in an arc-like shape to form an arc-like portion;

a supporting portion being fixed proximate to the arc-like portion of the binding body or the endless binding body, and supporting at least a bottom surface of a distal end of a toothbrush; and a moving member being movable in a direction toward the supporting portion or a direction opposite from the supporting portion while being guided by the binding body or the endless binding body, the moving member being formed with an elongated slot or a groove portion for inserting the binding body or the endless binding body therethrough.

* * * * *